US005798741A

United States Patent [19]

Kajihara

[11] Patent Number: 5,798,741

[45] Date of Patent: Aug. 25, 1998

[54] POWER SOURCE FOR DRIVING LIQUID CRYSTAL

[75] Inventor: Noriyuki Kajihara, Nara, Japan

[73] Assignee: Sharp Kabushiki Kaisha, Osaka, Japan

[21] Appl. No.: 466,991

[22] Filed: Jun. 6, 1995

[30] Foreign Application Priority Data

Dec. 28, 1994 [JP] Japan ..... 6-329152

[51] Int. Cl.[6] ..... G09G 3/36

[52] U.S. Cl. ..... 345/94; 345/95; 345/210; 345/211

[58] Field of Search ..... 345/87, 93, 94, 345/95, 100, 211, 210; 359/55, 84, 85; 315/169.1

[56] References Cited

U.S. PATENT DOCUMENTS

| | | | |
|---|---|---|---|
| 4,769,639 | 9/1988 | Kawamura et al. | 345/100 |
| 5,066,945 | 11/1991 | Kanno et al. | 345/94 |
| 5,198,747 | 3/1993 | Haight | 345/95 |
| 5,220,315 | 6/1993 | Clerc | 345/93 |
| 5,343,221 | 8/1994 | Arakawa et al. | 345/211 |
| 5,402,142 | 3/1995 | Okada et al. | 345/94 |
| 5,404,150 | 4/1995 | Murata | 345/95 |
| 5,434,599 | 7/1995 | Hirai et al. | 345/94 |

FOREIGN PATENT DOCUMENTS

| | | |
|---|---|---|
| 57-38497 | 3/1982 | Japan . |
| 63-55530 | 3/1988 | Japan . |
| 63-68819 | 3/1988 | Japan . |

*Primary Examiner*—Amare Mengistu

[57] ABSTRACT

A liquid crystal panel is driven with small number of kinds of voltage. First and second common voltages V0, V4 are generated symmetrically above and under the central common voltage V2 in the common voltage source. First and second segment voltages V1, V3 are generated symmetrically above and under the central common voltage V2 in the segment voltage source. Adjustment of contrast may be facilitated by adjusting common voltages and segment voltages independently or each other. Power may be realized by equalizing the segment voltages and the central common voltage when there is no display.

32 Claims, 23 Drawing Sheets

FIG. 2
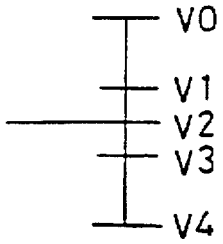
FIG. 3A
WAVEFORM OF COMMON OUTPUT
FIG. 3B
WAVEFORM OF SEGMENT OUTPUT
FIG. 3C
COMPOSITE WAVEFORM OF SEGMENT AND COMMON OUTPUTS
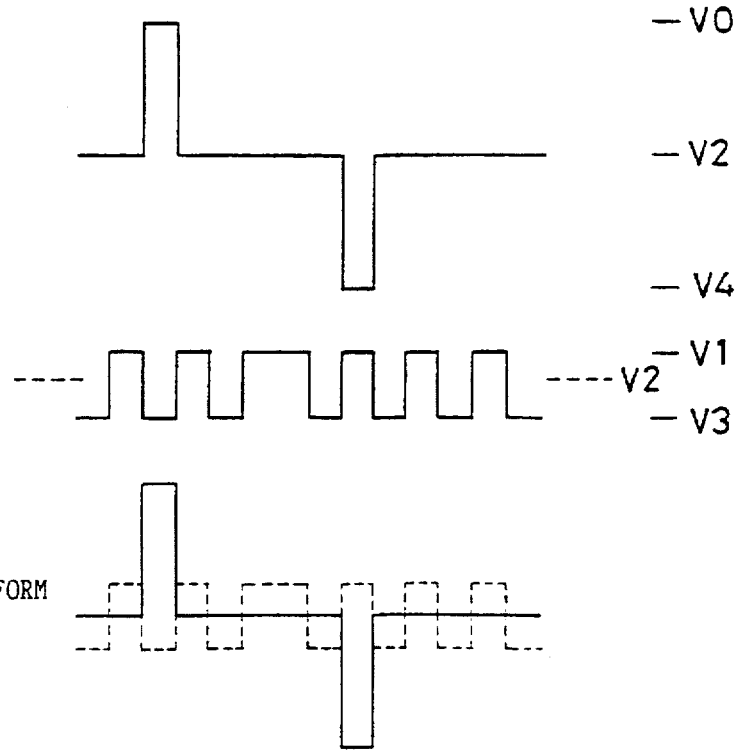

POWER SOURCE FOR DRIVING LIQUID CRYSTAL

BACKGROUND OF THE INVENTION

FIELD OF THE INVENTION

The present invention relates to a power source for driving a liquid crystal to be used for a matrix type liquid crystal display.

An example of a power source for driving a liquid crystal by the prior art is disclosed in Japanese Unexamined Patent Publication JPA 63-55530(1988). It will be explained by using an embodiment hereafter. FIG. 21 is a block diagram showing the general construction of a matrix type liquid crystal display of the prior art. Of voltages V0 to V5 from a liquid crystal driving power source 1 of the prior art, the voltages V0, V1, V4, V5 are supplied to a common driver 2 to drive the common electrodes in a liquid crystal panel 3, and the voltages V0, V2, V3, V5 are supplied to a segment driver 4 to drive the segment electrodes of the liquid crystal panel 3. FIG. 22 is an electric circuit diagram showing a general construction of the liquid crystal driving power source 1. The liquid crystal driving power source 1, which has split resistors R10 to R14 connected in series between 2 different kinds of supply voltages VDD, VEE with different voltages and operational amplifiers A7 to A10 connected to the connections of the respective split resistors, generates 6 different kinds of driving voltages V0 to V5 with different levels and supplies them to the respective drivers 2, 4. In this case, the split resistors R10 to R14 are preset in such a way that the common voltages V0, V1, V4, V5 and the segment voltages V0, V2, V3, V5 have a potential dividing ratio suitable to the duty ratio of the matrix type liquid crystal panel 3, and then the supply voltage V0 or V5 are varied to adjust the contrast.

The liquid crystal panel 3 receives prescribed voltages from the driving power source 1, and then outputs, on the common side, non selected level voltages V1, V4 and selected level voltages V0, V5 by the inputted data each frame as shown in FIG. 23A and outputs, on the segment side, non selected level voltages V2, V3 and selected level voltages V0, V5 each frame in the same way as shown in FIG. 23B, to drive the liquid crystal with a composite waveform as shown in FIG. 23C. As explained above, this drive method requires 4 different driving voltages for each of the common side and the segment side and the driving power source 1 must output the six driving voltages V0 to V5 with different levels accordingly.

Moreover, another problem of this conventional drive system is that the driving output level of each voltage greatly fluctuates on both the common side and the segment side, producing waveform distortion of level 5, etc. as shown in FIG. 23B, which degrades the display definition and having negative influences in the case of high-definition display such as large-screen display, graded display, etc.

Next, a prior art designed to facilitate adjustment by reducing the number of points of adjustment, which is disclosed in Japanese Unexamined Patent Publication JPA 63-68819 (1988), will be explained by using FIG. 24. The prior art is constructed in a way to generate a reference voltage from a DC power supply E and generate driving voltages of different levels by combining non-inverted amplifiers and inverted amplifiers from that reference voltage so as to reduce the number of points of adjustment. The DC power supply E is submitted to division of potential by a variable resistor R1 and a resistor R2, supplied to a differential amplifier A1 as a reference voltage of that divided voltage, amplified at a magnification determined by the values of resistors Ra, Rb, output as the liquid crystal driving voltage V1, further supplied to the differential amplifier A2 through a resistor Rc, inverted in polarity and amplified by a magnification determined by resistors Rc, Rd to provide the liquid crystal driving voltage V5. The output of the differential amplifier A1 is divided by resistors R3, R4 and inputted in a differential amplifier A3 to output the liquid crystal driving voltage V2, and is also inputted in a differential amplifier A4 through a resistor Re, inverted in polarity and amplified by a magnification determined by resistors Re, Rf to provide the driving voltage V4. In this way, it becomes possible to obtain the common voltages V1, V5 and segment voltages V2, V4 and obtain voltages vertically symmetrical about the grounding voltage V3.

With the prior art as shown in FIG. 24, it is impossible to adjust the common voltages V1, V5 and segment voltages V2, V4 independently. Namely, any change in the values of the resistors Ra, Rb changes not only the common voltages V1, V5 but also the segment voltages V2, V4.

Another example of a liquid crystal driving power source of the prior art is disclosed in Japanese Unexamined Patent Publication JPA 57-38497(1982). The construction of the prior art will be explained hereafter with reference to FIGS. 25 to 27. Firstly, the concrete construction of the block diagram of FIG. 25 is shown in FIG. 26 and this provides the voltage waveforms as shown in FIGS. 27A, 27B, 27C. In the prior art is used a voltage averaging method for preventing cross talk and FIG. 27 A represents the waveform of a voltage given to the scanning electrodes i.e. common electrodes, FIG. 27 B the waveform of a voltage given to the row electrodes i.e. segment electrodes and FIG. 27 C the waveform of a voltage applied between the common electrodes and the segment electrodes to act on the liquid crystal. A peak voltage 2V2 is applied to the segment electrodes, while a voltage with a voltage waveform superposed with a DC voltage V2 (see FIG. 27 A) is applied to the common electrodes to set off the DC component on the liquid crystal panel from the viewpoint of AC drive of the liquid crystal.

In a power source construction of FIG. 25, while the power source V0 is used for driving a logic device, this voltage is converted into a floating voltage of 2·V1 through the DC/DC converter and this is further converted into four voltages of ±V1+V2, V2, 2·V2 by using a variable output power source. Additionally, this power source can be internally adjusted so as to satisfy a relation of V1=K·V2 (K: optional constant). Therefore, when the variable output power source is adjusted so as to satisfy a relation of K=n (N: number of scanning electrodes), it is possible to take out a desired voltage by changing only the 2·V1 without spoiling the optimal voltage averaging method.

In FIG. 26 showing the concrete construction of FIG. 25, a voltage for driving the logic device is taken out from the power source V0 and, at the same time, this voltage is converted into a floating voltage of 2·V1 through the DC/DC converter and this is further converted into four voltages of (±V1+V2), V2, 2·V2 by using a variable output power source. To be concrete, it is possible to set the output voltages (V1+V2), (−V1+V2) with an operational amplifier 16*a* and resistors Ra1, Rb1 in FIG. 26, to adjust the magnitude of the voltage V2 by changing the ratio of the resistors Ra1, Rb1, and to adjust the magnitude of the voltage V1 with a variable resistor Ra. The intermediate voltage of the voltages (V1+V2), (−V1+V2) generated in this way is outputted as the voltage V2 through an operational amplifier 16b and the resistors, while a voltage 2·V2 twice as large as the voltage V2 is generated by the operating amplifier 16c.

Moreover, the concrete electric circuit of the construction shown in FIG. 28 is given in FIG. 29, and the construction of FIG. 28 and FIG. 29 also outputs the voltages of waveforms shown in FIGS. 27A, 27B, 27C. In this power source construction, a voltage for driving the logic device is taken out from the power source V0 and, at the same time, the voltage V0 is converted into voltages V2, 2·V2 through a variable output power source 6. Moreover, the voltage V0 is converted into a floating voltage 2·V1 through a DC/DC converter and 2 voltages (±V1+V2) are taken out with the use of a variable output power source 7. With such a power source construction, it is possible to reduce the converter size because there is no burden to the DC/DC converter in relation to the voltages V2, 2·V2 compared with the power source construction of FIG. 25 and also reduce the power consumption with improved availability of the power source V0.

In FIG. 29, a voltage for driving the logic device is taken out from the power source V0 and, at the same time, an optional voltage V2 is generated from this voltage by means of an operational amplifier 16a and resistors and the optional voltage V2 is amplified to a double value by means of an operational amplifier 16b and resistors. Furthermore, voltages vertically symmetrical (±V1+V2) about the voltage V2 are generated by means of peripheral circuits.

In this way, the two circuits of FIGS. 25–29, which are different in construction, can each output voltages (±V1+V2), V2 for driving the common side and voltage 2·V2 for driving the segment side. In the prior art as shown in FIGS. 25 to 29, particularly as seen from the waveforms of FIGS. 27A, 27B, 27C, since the common voltages and the segment voltages are not vertically symmetrical about the voltage V0, there arises a problem that the setting of the respective voltages is troublesome.

Moreover, in the prior art as shown in FIGS. 25 to 29 turning off of display on the liquid crystal panel 3 is realized particularly as shown in FIG. 21, by providing in advance a selector inside drivers 2, 4 respectively, and by switching the respective driving voltages applied to the liquid crystal panel 3 all to voltages of one and same non-selected level to shut off the voltage applied to the liquid crystal as shown in FIG. 21 in particular. To be concrete, the respective driving output voltages of the drivers 2, 4 all come to the level V5 if a selector switch for turning off display is provided in the drivers 2, 4 of FIG. 21 and "Display off" is selected.

As explained above, the turning off of display is made on the part of the drivers 2, 4 with the prior art. An actual liquid crystal display uses a plural number of drivers and, therefore, requires switches in the same number as that of the drivers. Moreover, it is generally said that about 60% of power consumption by the liquid crystal drive system of a liquid crystal display is consumed by the power source for driving the liquid crystal and, especially, there is no choice but flow an idling current to the output part of the power source output circuit for driving the liquid crystal to maintain the charging/discharging speed to the liquid crystal and to also maintain a good picture quality. This current represents the greater part of the current used by the power source for driving the liquid crystal. Moreover, though this current is unnecessary when the display is completely turned off because no differential potential is generated in the liquid crystal, the current situation is that a certain current is always flowing as a reactive current.

SUMMARY OF THE INVENTION

An object of the invention is to provide a power source for driving a liquid crystal capable of adjusting the common voltage and the segment voltage independently of each other to thereby facilitate the adjustment of contrast, enable low voltage operation for reduced power consumption and miniaturization by adoption of integrated circuits, and also improve the display.

Another object of the invention is to provide a power source for driving a liquid crystal capable of turning off the liquid crystal display.

The invention provides a liquid crystal driving power source for a matrix type liquid crystal display in which a plurality of common electrodes and a plurality of segment electrodes are arranged in a way to cross each other through a liquid crystal, the liquid crystal driving power source comprising:

a common voltage source for generating voltages to be applied to the plurality of common electrodes, the common voltage source generating a first common voltage V0 and a second common voltage V4 above and under the central common voltage V2, respectively, and a segment voltage source for generating voltages to be applied to the plurality of segment electrodes, the segment voltage source to which the central common voltage V2 is given and which generates a first segment voltage V1 and a second segment voltage V3 above and under the central common voltage V2, respectively, which do not exceed the first and second common voltages V0, V4.

Moreover, the invention provides a liquid crystal driving power source for a matrix type liquid crystal display in which a plurality of common electrodes and a plurality of segment electrodes are arranged in a way to cross each other through a liquid crystal, the liquid crystal driving power source comprising:

a segment voltage source for generating voltages to be applied to the plurality of segment electrodes, the segment voltage source generating a first segment voltage V1 and a second segment voltage V3 above and under the central common voltage V2, respectively, and a common voltage source for generating voltages to be applied to the plurality of common electrodes, the common voltage source to which the central common voltage V2 is given and which generates a first common voltage V0 and a second common voltage V4 above and under the central common voltage V2, respectively, which exceed the first and second segment voltages V1, V3.

Furthermore, the invention is characterized in that the common voltage source comprises:

a first differential amplifier generating the first common voltage V0 corresponding to the difference of the central common voltage V2 from one of the first and second segment voltages V1, V3, and a second differential amplifier generating the second common voltage V4 corresponding to the difference of the central common voltage V2 from the other of the first and second segment voltages V1, V3, and further comprises:

a section for equalizing the first and second segment voltages V1, V3 with the central common voltage V2 when displaying is not carried out.

Still more, the invention provides a liquid crystal driving power source for a matrix type liquid crystal display in which a plurality of common electrodes and a plurality of segment electrodes are arranged in a way to cross each other through a liquid crystal, the liquid crystal driving power source comprising:

a section for generating a central common voltage V2 for the plurality of common electrodes, a current source capable of supplying a predetermined constant current and shutting off that current, a section for generating a first common voltage V0, interposed between the a section means for generating the central common voltage and the current source, a section for generating a first segment voltage V1, interposed between the a section for generating the central common voltage and the power source, a first differential amplifier generating a second common voltage V4 corresponding to the difference between the central common voltage V2 and the first common voltage V0, a second differential amplifier generating a second segment voltage V3 corresponding to the difference between the central common voltage V2 and the first segment voltage V1, and a section for shutting off the current source when displaying is not carried out.

According to the invention, which is designed in a way to generate first and second common voltages V0, V4 above and under the central common voltage V2 and generate first and second segment voltages V1, V3 above and under the central common voltage V2, it is possible to have 5 voltages in total symmetry on both sides of the central common voltage V2 and thus reduce the number of different kinds of voltage to be generated as much as possible.

And yet, it is also possible to adjust the respective ouput voltages of the common voltage sources and segment voltage sources independently of each other and to thereby facilitate the adjustment of contrast.

Moreover, the segment voltage is available in 2 different values i.e. first and second segment voltages V1, V3 and this makes it possible to reduce the difference of potential between those voltages V1, V3. Therefore, the supply voltage of the segment voltage sources and the driver for driving the segment electrode can be reduced, enabling reduction of power consumption. This further enables miniaturization of process and compact construction through realization by integrated circuit. In this way, it becomes possible to realize a power source for driving a liquid crystal capable of compact construction and cost reduction without using any discrete parts i.e. individual electronic parts.

Furthermore, according to the invention, it is also possible to reduce the difference of potential between the first and second segment voltages V1, V3 as mentioned above, thus eliminating the distortion of voltage waveform given by the segment driver to the segment electrode as shown with the reference symbol 5 in FIG. 23 described in relation to the prior art. This makes it possible to improve the quality of display of the display panel which is a matrix type display unit.

Still more, according to the invention, it becomes possible to make the first and second common voltages V0, V4 and the first and second segment voltages V1, V3 agree with the central common voltage V2 by equalizing the first and the second segment voltages V1, V3 with the central common voltage V2 when no display is made, because the common voltage sources are designed to provide the first and second common voltages V0, V4 with the first and second differential amplifiers to which the central common voltage V2 and the first and second segment voltages V1, V3 are given. This enables to reduce the drive current given to the liquid crystal display and also turn off display at the power source for driving the liquid crystal display unit.

Yet more, according to the invention, a first common voltage V0 is generated by using a current source and a first common voltage producing means such as resistor, etc. and using the central common voltage V2 as a reference, and thereby at the first differential amplifier, a second common voltage V4 in correspondence to the difference between the central common voltage V2 and the first common voltage V0 is generated. Similarly, also a first segment voltage V1 is generated by using a current source and a first segment voltage producing means such as resistor, etc. and using the central common voltage V2 as a reference, and in the first differential amplifier, a second segment voltage V3 corresponding to the difference with the central common voltage V2 is generated by using this first segment voltage V1. As the current source is shut off in such construction, the first common voltage V0 and the second segment voltage V3 are equalized with the central common voltage V2 and all of the voltages V0, V4, V1, V3 come to agree with the central common voltage V2, thus making it possible to turn off the display of the liquid crystal display unit at the power source for driving the liquid crystal display.

As described above, according to the invention, which uses a central common voltage V2 and upper a lower first and second common voltages V0, V4 on both sides of the central common voltage V2 to drive common electrodes and generates first and second segment voltages V1, V3 for driving segments on both sides of this central common voltage V2, the respective voltages V0 to V4 are comparatively small in number of kinds and this enables to simplify the construction of the power source for driving a liquid crystal display.

Moreover, according to the invention, it is possible to adjust the first and second common voltages V0, V4 and the first and second segment voltages V1, V3 independently of each other, thereby achieving the effect of facilitating the adjustment of contrast of the liquid crystal display.

Furthermore, according to the invention, the first and second segment voltages V1, V3 for driving segment electrodes are available in 2 different kinds of value, and this makes it possible to reduce the difference of potential between the voltages V1 and V3. Therefore, the supply voltage of the driver for driving the segment electrodes can be reduced, enabling reduction of power consumption. This further enables realization by integrated circuit, hence compact construction by miniaturized process. In the invention, the construction can be made more compact compared with that of the prior art, and this makes it possible to reduce the cost and enables realization in compact size by eliminating the problem of large printed circuit board area.

Furthermore, according to the invention, it is possible to reduce the difference of potential between the first and the second segment voltages V1, V3, thereby eliminating distortion of waveforms. Therefore, an effect of improving the quality of display of a liquid crystal display is also achieved.

Still more, according to the invention, because the first and second common voltages V0, V4 are generated on both sides of the central common voltage V2 and that the first and second segment voltages V1, V3 are generated on both sides of this central common voltage V2, the respective voltages V0 to V4 can be obtained symmetrically and this also enables to simplify the construction and facilitate the voltage adjustment.

Yet more, according to the invention, the first and second common voltages V0, V4 and the first and second segment voltages V1, V3 can be equalized with the central common voltage V2 when no display is made on the liquid crystal display unit i.e. when the display is turned off. This makes it possible to reduce power consumption when no display is made by preventing flowing of electric current to the liquid crystal display. It is also possible to make the turning off operation of the display at the power source for driving a liquid crystal and, as mentioned earlier in relation to the prior art, simplification of construction also becomes possible because there is no need of providing any special switching for turning off display on the driver.

BRIEF DESCRIPTION OF THE DRAWINGS

Other and further objects, features, and advantages of the invention will be more explicit from the following detailed description taken with reference to the drawings wherein:

FIG. 2 is a drawing showing voltage levels obtained from a power source 21 for driving a liquid crystal;

FIGS. 3A, 3B, 3C are drawings showing voltage waveforms with which a liquid crystal panel 25 is driven;

DETAILED DESCRIPTION OF THE PREFERRED EMBODIMENT

Figure 1:
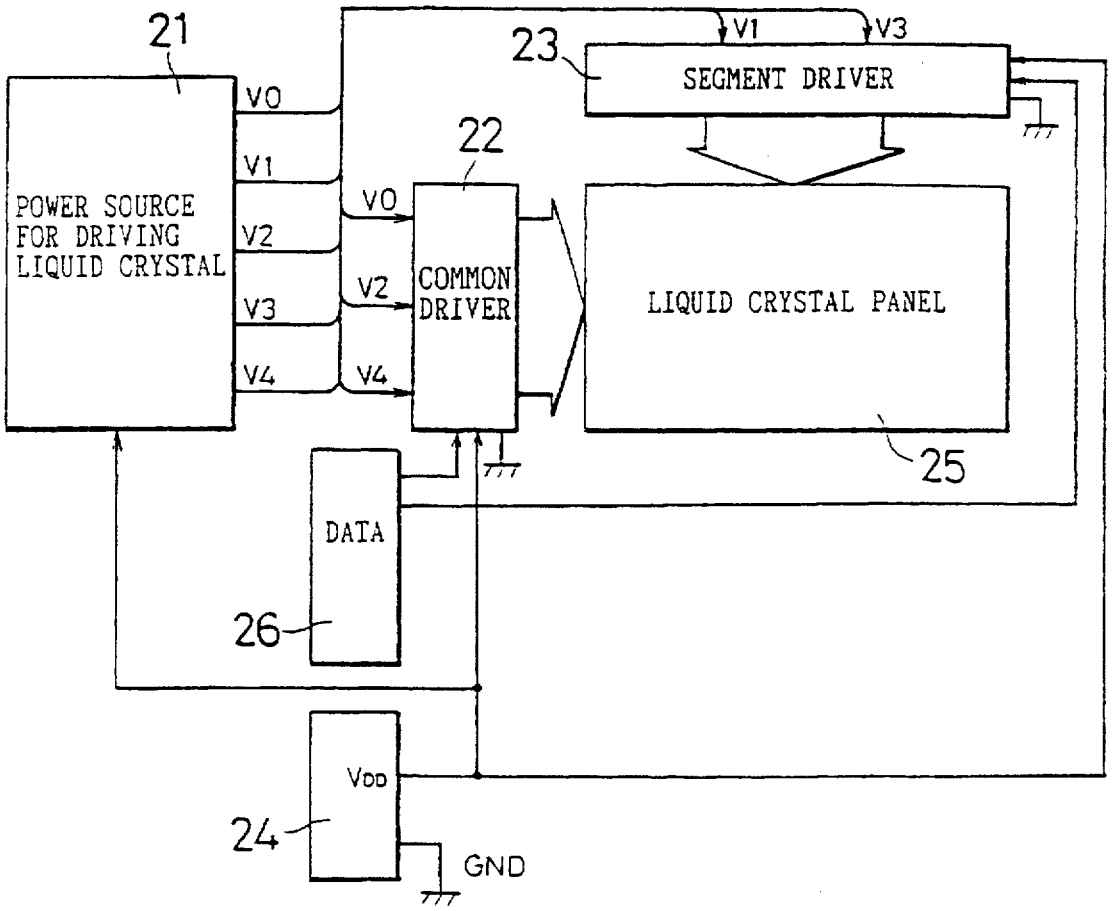
FIG. 1 is a block diagram showing a general construction of a liquid crystal display of an embodiment of the invention.

Now referring to the drawings, preferred embodiments of the invention are described below.

FIG. 1 is a block diagram showing a general construction of a liquid crystal display unit including a power source 21 for driving a liquid crystal of the invention. The power source 21 for driving a liquid crystal generates first and second common voltages V0, V4 symmetrically above and under a central common voltage V2 as shown in FIG. 2 and supplies them to a common driver 22 and also generates first and second segment voltages V1, V3 symmetrically above and under the central common voltage V2 and supplies them to a segment driver 23. Electric power is given to those drivers 22, 23 from a power circuit 24 to drive a panel 25 which is a matrix type liquid crystal display.

The liquid crystal panel 25 has a plurality of common electrodes which are line electrodes and a plurality of segment electrodes which are row electrodes arranged in a way to cross each other through a liquid crystal, and the common electrodes function as scanning electrodes while the segment electrodes work as display electrodes, thus achieving a liquid crystal display. The data to be displayed is given by a data generating circuit 26 to the respective drivers 22, 23 to selectively drive the common electrodes and the segment electrodes.

Here, the following equation is established in relation to those voltages V1 to V4:

$$V0-V2=V2-V4 \quad (1)$$

$$V1-V2=V2-V3 \quad (2)$$

FIG. 3 indicates the voltage waveform conducted from the respective drivers 22, 23. The voltage shown in FIG. 3 A is given to the common electrodes. The first and second common voltages V0, V4 have a difference of potential of, for example, 20 to 30V with regard to the central common voltage V2.

The output waveform of the segment driver 23 is shown in FIG. 3B and the first and second segment voltages V1, V3 on both sides of the central common voltage V2 have a difference of potential of, for example, 1.5V, with regard to the central common voltage V2. As a result, the synthesized waveform applied between the common electrodes and the segment electrodes in the liquid crystal panel 25 becomes the waveform shown in FIG. 3C. The broken line represents the segment voltage shown in FIG. 3B. In this way, the first and second common voltages V0, V4 are generated symmetrically on both sides of the central common voltage V2 and the first and second segment voltages V1, V3 are also generated symmetrically on both sides of the central common voltage V2, enabling simplification of construction of the power source 21 for driving a liquid crystal of the invention. The number of Rinds of voltage is 5, which is comparatively small, resulting in further simplification of the construction.

Figure 4:
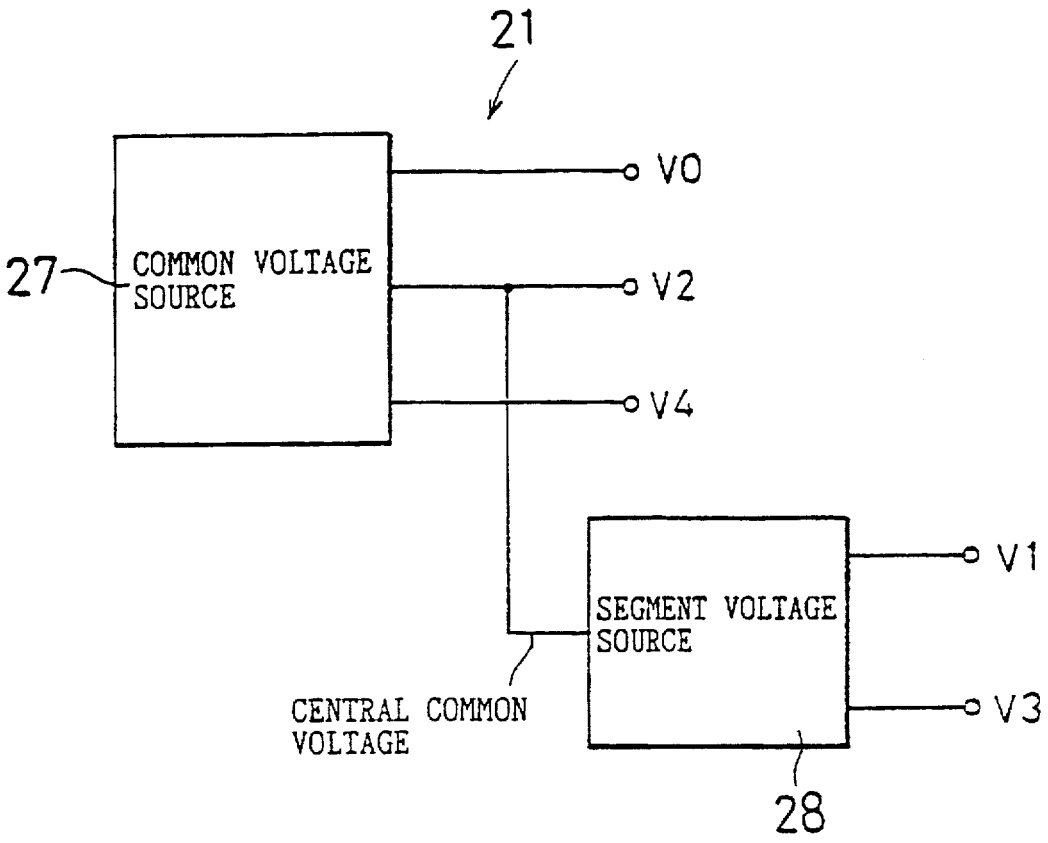
FIG. 4 is a block diagram showing a construction of a power source 21 for driving a liquid crystal of an embodiment of the invention.

FIG. 4 is a block diagram showing the construction of the power source 21 for driving a liquid crystal in a simplified form. A common voltage source 27 generates voltages V2, V0, V4 to be applied to the common electrodes as described earlier. A segment voltage source 28, to which the central common voltage V2 is applied, generates 2 different kinds of voltages V1, V3 as described above. The first and second segment voltages V1, V3 are smaller than the first and second common voltages V0, V4 and this is also apparent from FIG. 2.

Figure 5:
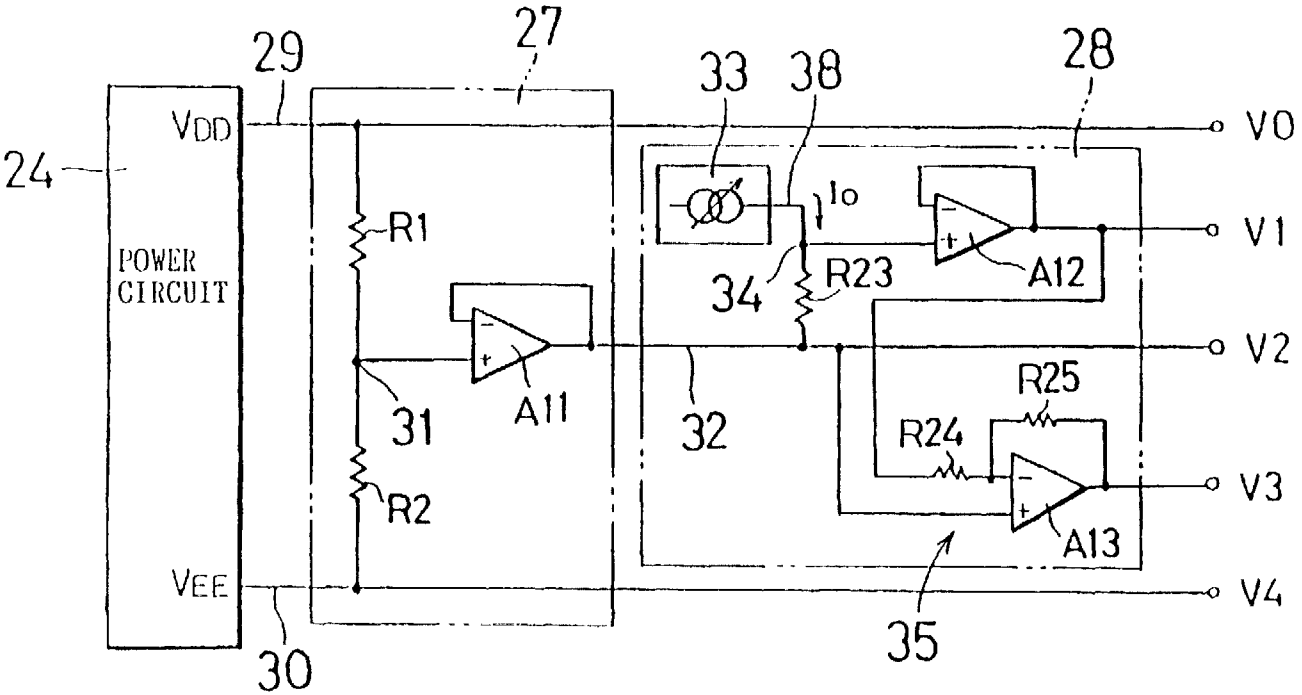
FIG. 5 is an electric circuit diagram showing a concrete construction of a power source 21 for driving a liquid crystal shown in FIG. 4.

FIG. 5 is an electric circuit diagram showing the concrete construction of the power source 21 for driving a liquid crystal shown in FIG. 4. The voltage of the power circuit 24 is conducted through lines 29, 30, and an intermediate voltage between the voltages VDD and VEE is obtained from the connection 31 by means of resistors R1, R2 of equal resistance values. The voltage of a connection 31 is given to an operational amplifier A11 to be converted into impedance and delivered from a line 32 as central common voltage V2. The respective voltages VDD and VEE of the lines 29, 30 are used as first and second common voltages V0, V4. The segment voltage source 28 has a reference current source 33 and is capable of setting a current value 10 for it independently of the voltages VDD and VEE of the lines 29, 30 of the power circuit 24. This constant current value I0 flows into a resistor R23 to provide the voltage (V2+R23I0) at a connection 34, and this voltage is converted into impedance in an operational amplifier A12 and then outputted as first segment voltage V1.

Resistors R24, R25 are connected to an operational amplifier A13 constituting the differential amplifier 35. The central common voltage V2 of the line 32 and the first segment voltage V1 are given to this differential amplifier 35, to thereby provide a second segment voltage V3 of a polarity inverse to that of the first segment voltage V1.

$$V1=V2+(R23*I0) \quad (3)$$

$$V3=V2-(R23*I0) \quad (4)$$

Here, the respective values are determined in a way to establish the following relation:

$$R24=R25 \quad (5)$$

In the above description and the description given hereafter, the resistance value of the resistors may be indicated with one and the same reference symbol.

The invention is constructed in a way to make the output current 10 of the reference current source 33 variable. This makes it possible to generate first and second segment voltages V1, V3 symmetrically on both sides of the central common voltage V2, thus facilitating the adjustment of contrast.

Figure 6:
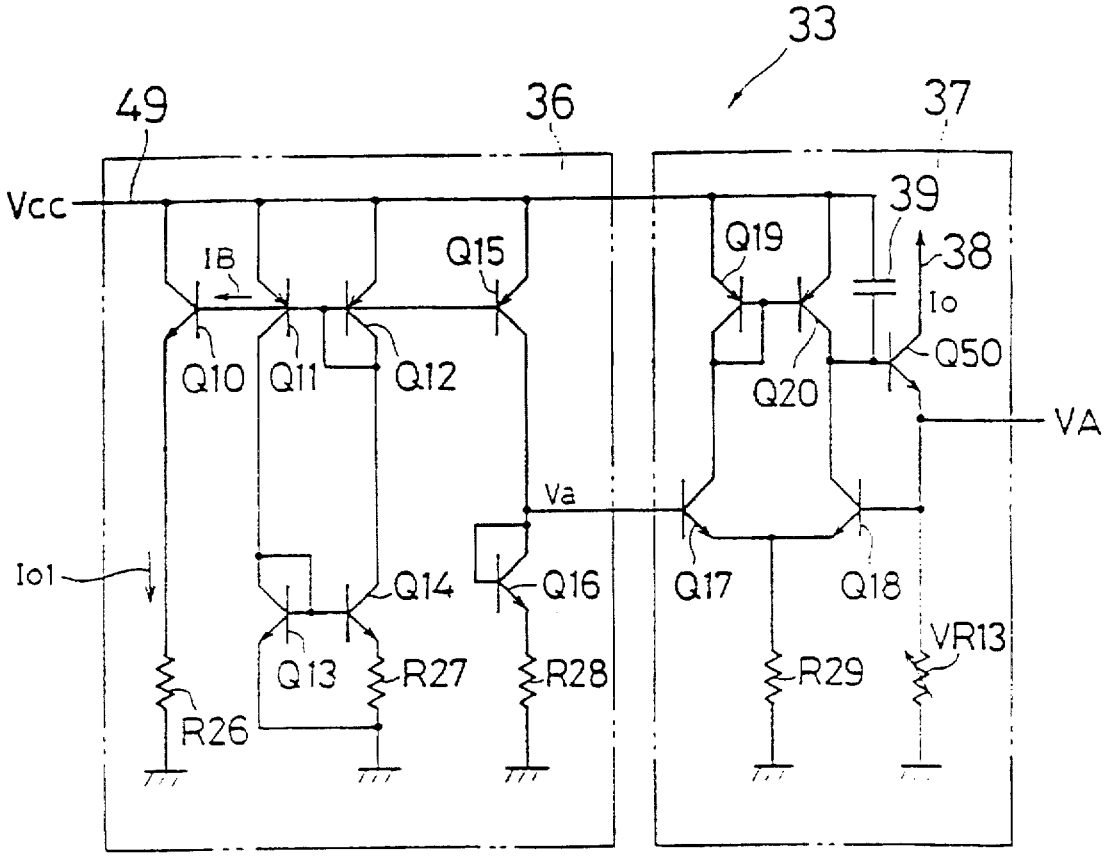
FIG. 6 is an electric circuit diagram showing a concrete construction of a reference current source 33 used in FIG. 5.

FIG. 6 is a concrete electric circuit diagram showing the construction of the reference current source 33. This reference current source 33 inputs the output voltage Va of a so-called band-gap constant voltage source 36 in a differential circuit 37 and thus receives the output voltage thereof at a variable resistor VR13 to generate a reference current I0, which is led from a line 38 to the connection 34. Here, the band-gap constant voltage source 36 comprises resistors R26 to R28 and transistors Q10 to Q16, the emitter surface area of the transistor Q14 being selected to be 10 times larger, for example, than the emitter surface area of the transistor Q13, and is provided with the resistor R27 to be connected in series to this transistor Q14. The resistor R28 connected in series to the transistor Q16 for output is selected to have a resistance value 10 times larger than that of the resistor R27.

The differential circuit 37 comprises a resistor R29, the aforementioned variable resistor VR13, transistors Q17 to Q20, Q50 and a capacitor 39. The following equation is established regarding the reference current I0:

$$I0=Va/VR13 \quad (6)$$

Here, the output value Va of the band-gap constant voltage source 36 is, for example, approximately 1.3V.

The transistor Q10 and the resistor R26 constitute a starting circuit. When a power source Vcc is applied to this starting circuit, the transistor Q10 flows a current I01 which is determined by the resistor R26, and this makes IB, which is the base current of the transistor Q10, flow. This base current IB becomes the base current of the current mirror circuit which is composed of transistors Q11, Q12, Q15, i.e. it becomes the base current of the transistors Q11, Q12, Q15. This makes the current mirror circuit start working to operate the band-gap constant voltage source 36.

The transistor Q13 and the transistor Q14 are constituted at a ratio of 1:10 in the number of transistors and a constant current I passes through them. For that reason, a voltage of ΔV is generated at both ends of the resistor R27.

$$\Delta V = VBE(Q13) - VBE(Q14) = \frac{kT}{q} \ln \frac{I(Q13)}{I(Q14)} = \frac{kT}{q} \ln \frac{Q14}{Q13} \quad (6a)$$

Therefore, since the current I1 is a current flowing through the resistor R, $$I1 = \frac{kT}{q} \ln \frac{Q14}{Q13} \times \frac{1}{R} \quad (6b)$$

(The resistance value of R27 is put as R and that of R28 is put as 10R.) The value of Va in the drawing is:

$$\begin{aligned} Va = VBE(Q16) + 10R \times I1 &= VBE(Q16) + 10 \cdot R \times \frac{kT}{q} \ln \frac{Q14}{Q13} \times \frac{1}{R} \\ &= VBE(Q16) + 10 \times \frac{kT}{q} \ln \frac{Q14}{Q13} \end{aligned} \quad (6c)$$

To differentiate the equation 6c with temperature, k: Boltzmann's constant 8.63×10−5 eV/°K q: Amount of electric charge=e From what has been stated above, because the first term is a temperature coefficient of VBE of approximately −2 mV/°C. and the second term is approximately +2 mV/°C., the both terms are set off to have a temperature coefficient of 0, thus providing a thermally stable voltage. By the equation 6c, the output voltage Va at this time is:

$$\frac{dVa}{dT} = \frac{d}{dT} VBE(Q16) + 10 \times \frac{kT}{q} \ln \frac{Q14}{Q13} \quad (6d)$$

$$\frac{k}{q} = 8.6 \times 10^{-5} \text{ V/°K.} \quad (6e)$$

$$\begin{aligned} Va &= VBE(Q16) + 10 \times \frac{kT}{q} \ln \frac{Q14}{Q13} = \\ &\quad VBE(Q16) + 10 \times \frac{kT}{q} \ln 10 \\ &= VBE(Q16) + 0.596 \text{ [V]} \quad [T = 300° \text{ K. is substituted}] \\ &= 0.7 + 0.596 \approx 1.3 \text{ [V]} \end{aligned} \quad (6f)$$

The differential circuit 37 is an operational amplifier.

Figure 7:
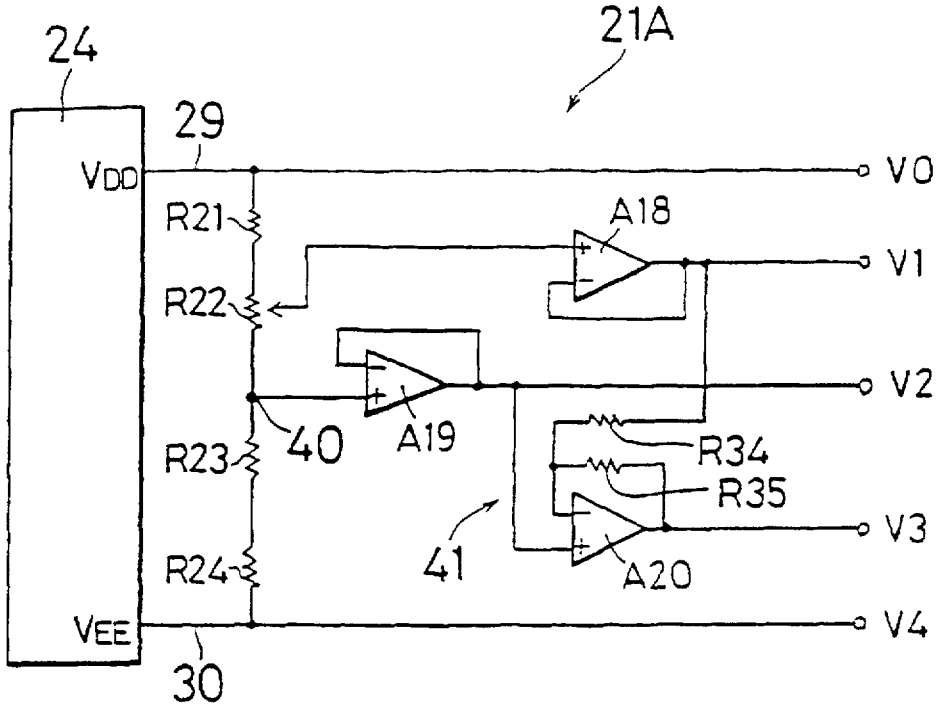
FIG. 7 is an electric circuit diagram of a power source 21A for driving a liquid crystal of another embodiment of the invention.

FIG. 7 is an electric circuit diagram showing the concrete construction of a power source 21A for driving a liquid crystal of another embodiment of the invention. The output voltages VDD, VEE of the power circuit 24 are divided by serial resistors R21 to R24 between the lines 29 and 30, and the voltage at the middle point 40 is converted into impedance by an operational amplifier A19 to provide the central common voltage V2. The voltage dividing resistor R22 is a variable resistor and the voltage obtained by that resistor is given to an operational amplifier A18, to thereby provide the first segment voltage V1. A differential amplifier 41, which is composed of an operational amplifier A20 and resistors R34, R35, is given the central common voltage V2 and the first segment voltage V1 and outputs the differential voltage thereof (V2−V1) as second segment voltage V3.

Figure 8:
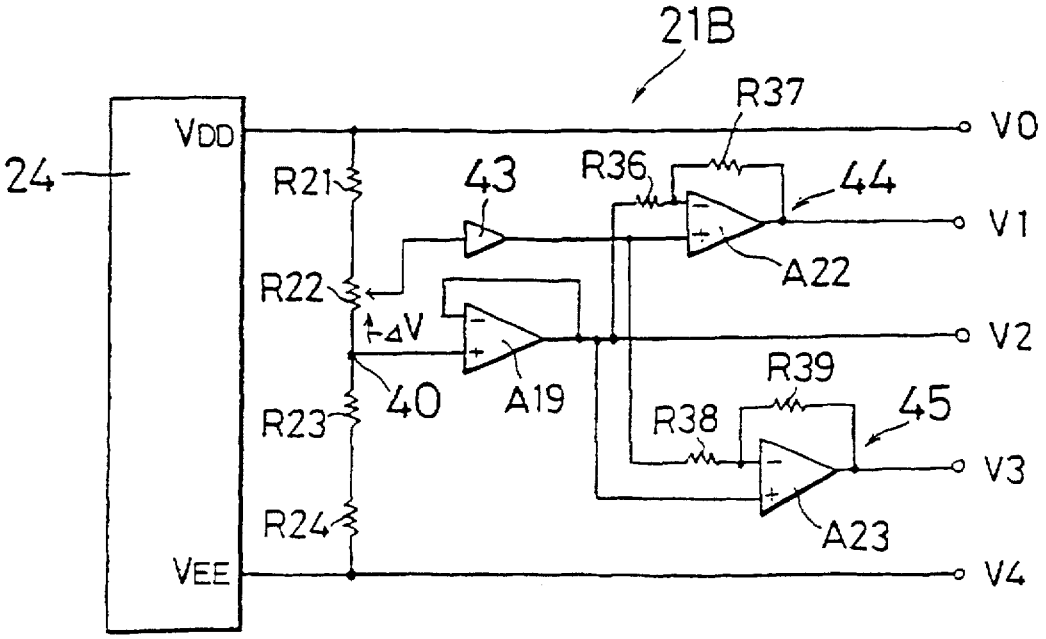
FIG. 8 is an electric circuit diagram showing a construction of a power source 21B for driving a liquid crystal of still another embodiment of the invention.

FIG. 8 is an electric circuit diagram of a liquid crystal driving power source 21B of still another embodiment of the invention. The power source 21B for driving a liquid shown in this FIG. 8 is similar to the embodiment of FIG. 7 and is given the same reference numerals for corresponding parts. The output voltage of the variable resistor R22 is given to a differential amplifier 44 through a buffer 43 and is also given to another differential amplifier 45. The differential amplifier 44 is realized with an operational amplifier A22 and resistors R36, R37. The differential amplifier 45 is realized with an operational amplifier A23 and resistors R38, R39. The values of the respective resistors R36, R37, R38, R39 which set the gain of the differential amplifiers 44, 45 are determined so as to satisfy the following equation (7):

$$(R36+R37)/R36=R39/R38 \quad (7)$$

To explain, in this FIG. 8, the reason for establishment of the equation 7, the gain of the operational amplifier A22, which is a non inverted amplifier, and that of the operational amplifier A23, which is an inverted amplifier, must be equal for the voltages V1 and V3 to be vertically symmetrical against the central common voltage V2.

$$\text{Output } V1 \text{ of operational amplifier } A22 = \frac{R36 + R37}{R36} \Delta V + V2 \quad (7a)$$

$$\text{Output } V2 \text{ of operational amplifier } A23 = -\frac{R39}{R38} \Delta V + V2 \quad (7b)$$

To equalize the above equations against the voltage V2, the following equation must be established:

$$\frac{R36 + R37}{R36} = \frac{R39}{R38} \quad (7c)$$

Figure 9:
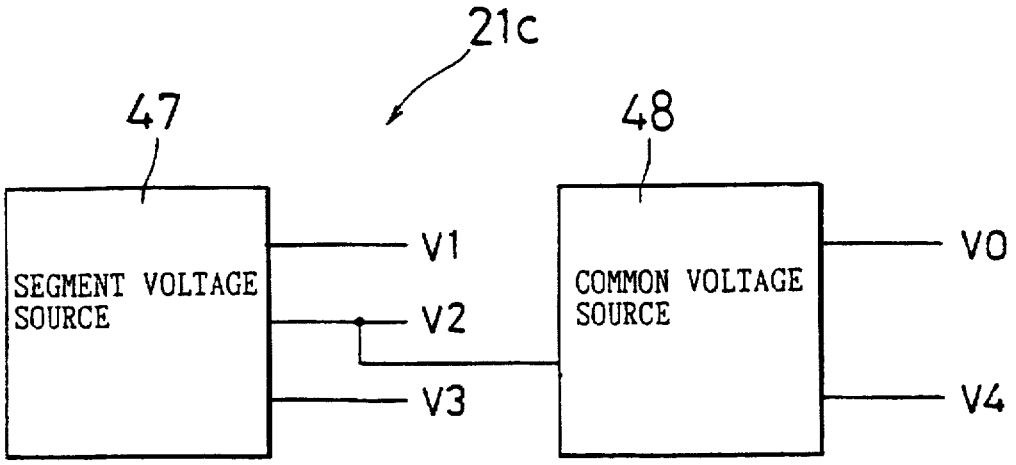
FIG. 9 is an electric circuit diagram showing a construction of a power source 21C for driving a liquid crystal of yet another embodiment of the invention.

FIG. 9 is an electric circuit diagram showing the construction of a power source 21C for driving a liquid crystal of yet another embodiment of the invention. A segment voltage source 47 generates the central common voltage V2 and also generates the first and second segment voltages V1, V3 symmetrically on both sides of the central common voltage V2. A common voltage source 48 is given the central common voltage V2 and generates the first and second common voltages V0, V4 which are larger than the first and second segment voltages V1, V3, respectively.

Figure 10:
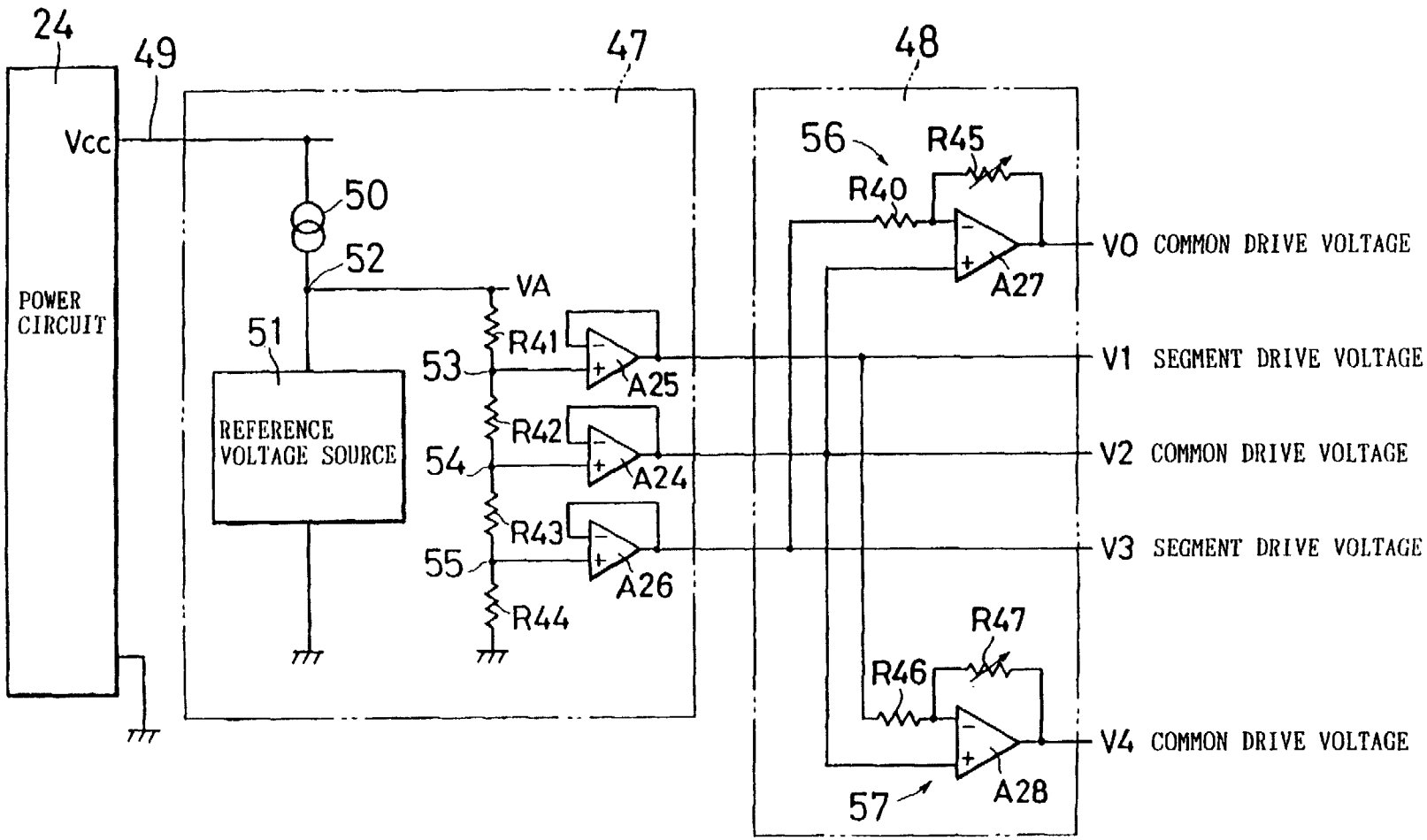
FIG. 10 is an electric circuit diagram showing a concrete electric construction of the power source 21C for driving a liquid crystal shown in FIG. 9.

In FIG. 10, voltage Vcc is given by the power circuit 24 to a line 49 and, in the segment voltage source 47, a reference voltage source 51 is connected to a current source 50 and serial resistors R41 to R44 for dividing potential are connected to the connections 52 thereof. From respective outputs of the connections thereof 53 to 55, the central common voltage V2 is obtained by an operational amplifier A24 while the first and second segment voltages V1, V3 symmetrically on both sides of the central common voltage V2 are obtained by operational amplifiers A25, A26.

Moreover, in the common voltage source 48, a amplifier 56 is realized with an operational amplifier A27 and resistors R40, R45 and is given the central common voltage V2 and the second segment voltage V3 to generate the first common voltage V0. Another differential amplifier 57 is realized with an operational amplifier A28 and resistors R46, R47. This differential amplifier 57 is given the central common voltage V2 and the first segment voltage V1 to produce the second common The reference voltage source 51 can provide a reference voltage VA by being given voltage Vcc from the power circuit 24 and a grounding voltage GND. The resistance values of the resistors R42, R43 are identical and the respective resistance values of the resistors R41 to R44 may all be equal, thus producing an intermediate voltage of the reference voltage VA at the connection 54 as central common voltage V2. Here the equation (2) given earlier is established. To put the gains of the differential amplifiers 56, 57 as GA56, GA57, equations are obtained as follows:

$$GA56=(R40+R45)/R40 \quad (8)$$

$$GA57=(R46+R47)/R46 \quad (9)$$

Here, by setting the conditions, $$R40=R45 \quad (10)$$

$$R46=R47 \quad (11)$$

the following equation is obtained:

$$GA56=GA57 \quad (12)$$

Consequently, the first and second common voltages V0, V4 can be obtained as values enabling establishment of equations (13), (14), and this enables establishment of the equation (1).

$$V0-V2=GA56*(V2-V3) \quad (13)$$

$$V2-V4=GA57*(V1-V2) \quad (14)$$

Figure 11:
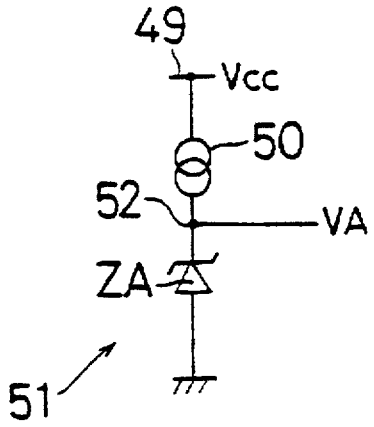
FIG. 11 is an electric circuit diagram showing a concrete electric construction of a reference voltage source 51 shown in FIG. 10.

FIG. 11 is an electric circuit diagram showing the concrete electric construction of the reference voltage source 51. A reference voltage source 51 is connected in series to the current source 50. The reference voltage source 51 is composed of a zener diode ZA, which has a constant voltage between both its ends regardless of the current flowing therein, when a voltage exceeding its break down voltage is applied.

Accordingly, the voltage between both ends of the zener diode ZA is maintained to be constant by selecting the voltage between both ends of the zener diode ZA, through which the current from the current source 50 flows, to be a value exceeding the break-down voltage of the zener diode ZA.

The voltage of the zener diode ZA is the output voltage VA, which is supplied to a dividing circuit composed of resistors R41 to R44.

Figure 12:
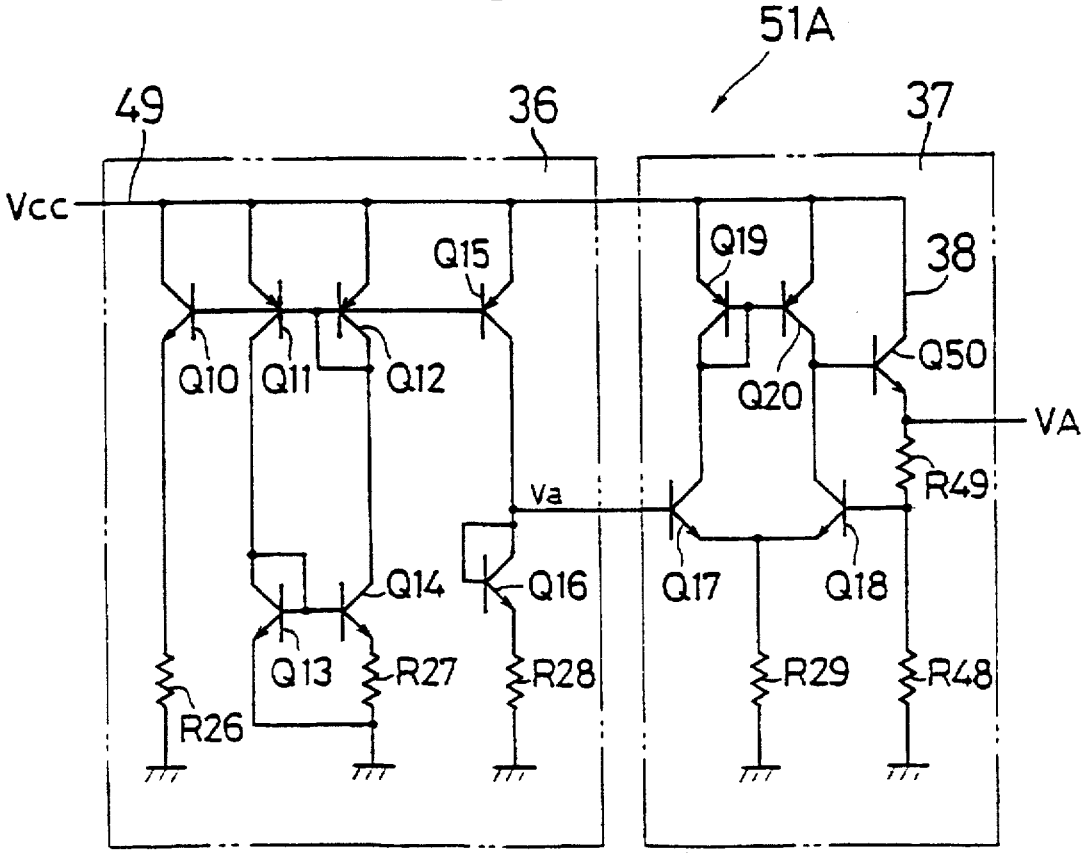
FIG. 12 is an electric circuit diagram showing a concrete construction of a reference voltage source 51 shown in FIG. 10.

FIG. 12 is an electric circuit diagram showing the concrete construction of the reference voltage source 51A of other embodiment of the invention. The construction shown in this FIG. 12 is similar to the construction shown in FIG. 6 and is given the same reference numerals for corresponding parts. The output voltage Va of the band-gap constant voltage source 36 is given to a differential circuit 37 to provide output voltage VA delivered from the emitter of the transistor Q20 included in this differential circuit 37. The following equation is established in relation to serial resistors R48, R49 connected to the transistor Q50:

$$VA=(R48+R49)/R48*Va \tag{15}$$

The band-gap constant voltage source 36 is similar to that in FIG. 6. In the differential circuit 37, the reference voltage Va is given to the base of the transistor Q17 to feed back the output from the differential circuit 37 to the base of the transistor Q18, which is an inverted input, from an output port of the differential circuit 37 via the resistor R49. Since the both inputs of the operational amplifier are subject to a feedback in a way to be the reference voltage Va, the base voltage of the transistor Q18 also becomes the reference voltage Va and this voltage is applied to the resistor R48. Therefore, since the output voltage VA is determined by the ratio of resistors R48 to R49, the following equation is established:

$$\text{Output voltage } VA = \frac{R48 + R49}{R48} Va \tag{15a}$$

VDD, VCC in the embodiment given earlier may be approximately 40V, for example, against the grounding potential.

Figure 13:
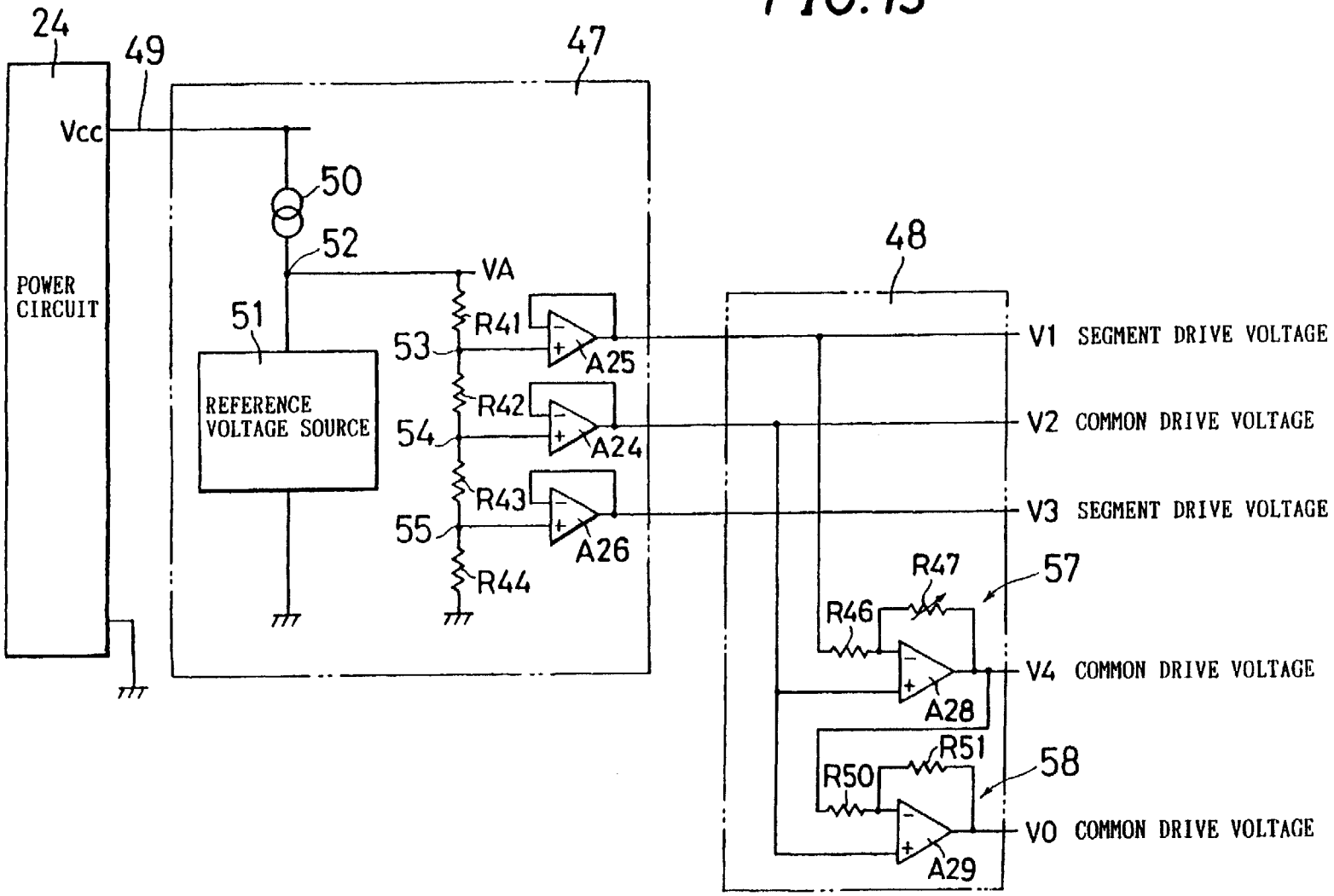
FIG. 13 is an electric circuit diagram showing a construction of the power source 21C for driving a liquid crystal shown in FIG. 9 of still another embodiment of the invention.

FIG. 13 is an electric circuit diagram of another embodiment of the invention. This embodiment is similar to the embodiment of FIG. 10 and is given the same reference numerals for corresponding parts. What is to be noted is that a differential amplifier 58 is provided in this embodiment. This differential amplifier 58 is composed of an operational amplifier 29 and resistors R50, R51 and provides the first common voltage V0 the polarity of which is inverse to that of the second common voltage V4 from the differential amplifier 57. By using a variable resistor as the resistor R47, it becomes possible to adjust both the first and second voltages V0, V4 at a time. At that time, the gain of the differential amplifier 58 is set as 1 and, for that purpose, the following equation is established:

$$R50=R51 \tag{16}$$

Figure 14:
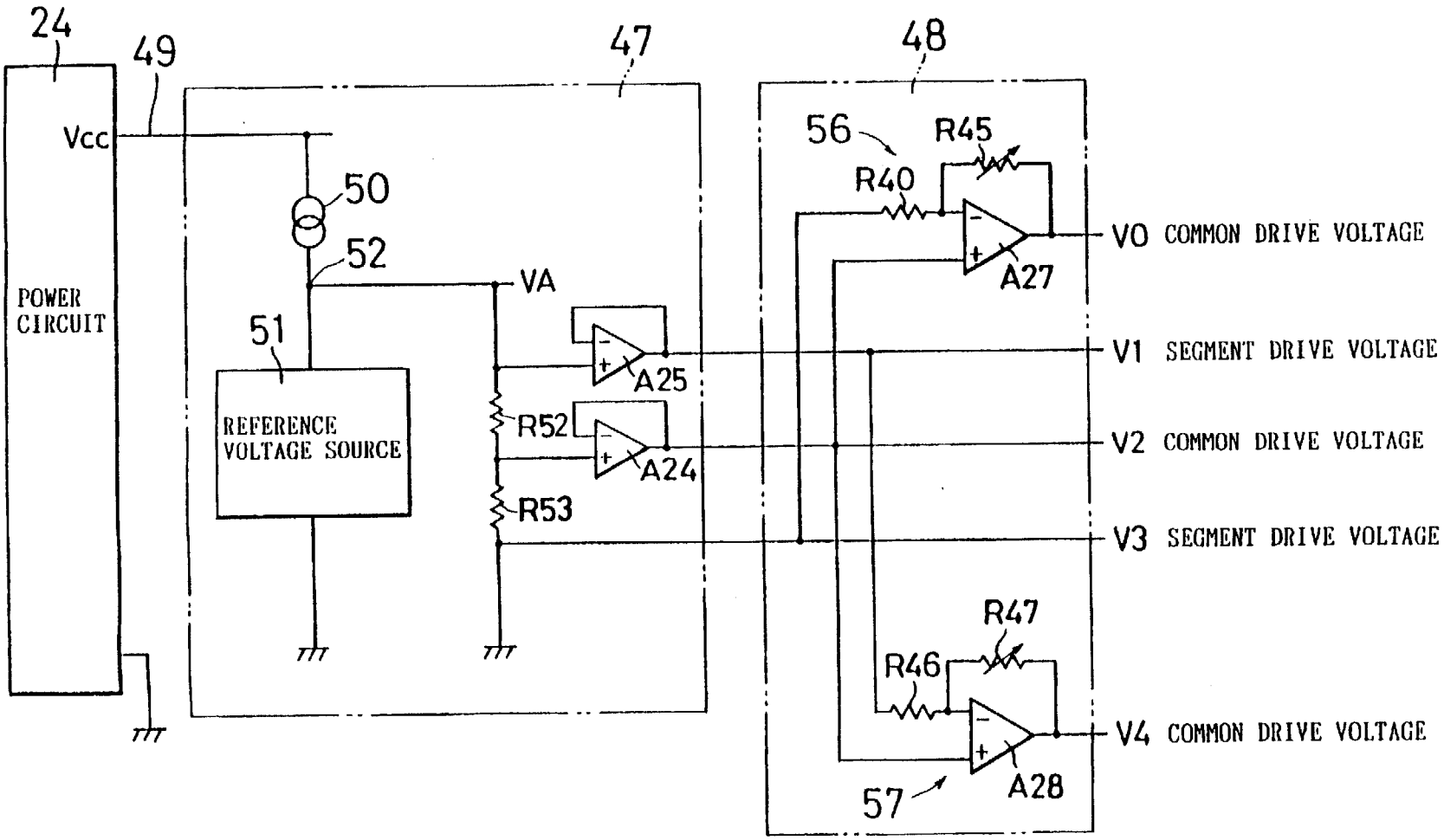
FIG. 14 is an electric circuit diagram showing a concrete construction of the power source 21C for driving a liquid crystal shown in FIG. 9 of still another embodiment of the invention.

FIG. 14 is an electric circuit diagram of another embodiment of the invention. This power source for driving a liquid crystal is similar to the embodiment shown in FIG. 10 and is given the same reference numerals for corresponding parts. What is to be noted is that, in this embodiment, the first and second segment voltages V1, V3 for driving segment electrodes realize a construction which enables sharing with a so-called logical power source. Namely, the first segment voltage V1 is delivered as the voltage VDD at the logical power source and the second segment voltage V3 is delivered as the grounding voltage GND of the logical power source. For that reason, the output voltage VA of the reference voltage source 51 at the connection 52 is divided by resistors R52, R53, and central common voltage V2 is delivered from the operational amplifier A24. The reference voltage VA is given to an operational amplifier A30 and is used as first segment voltage V1. Other parts of the construction are the same as that of the embodiment in FIG. 10.

Figure 15:
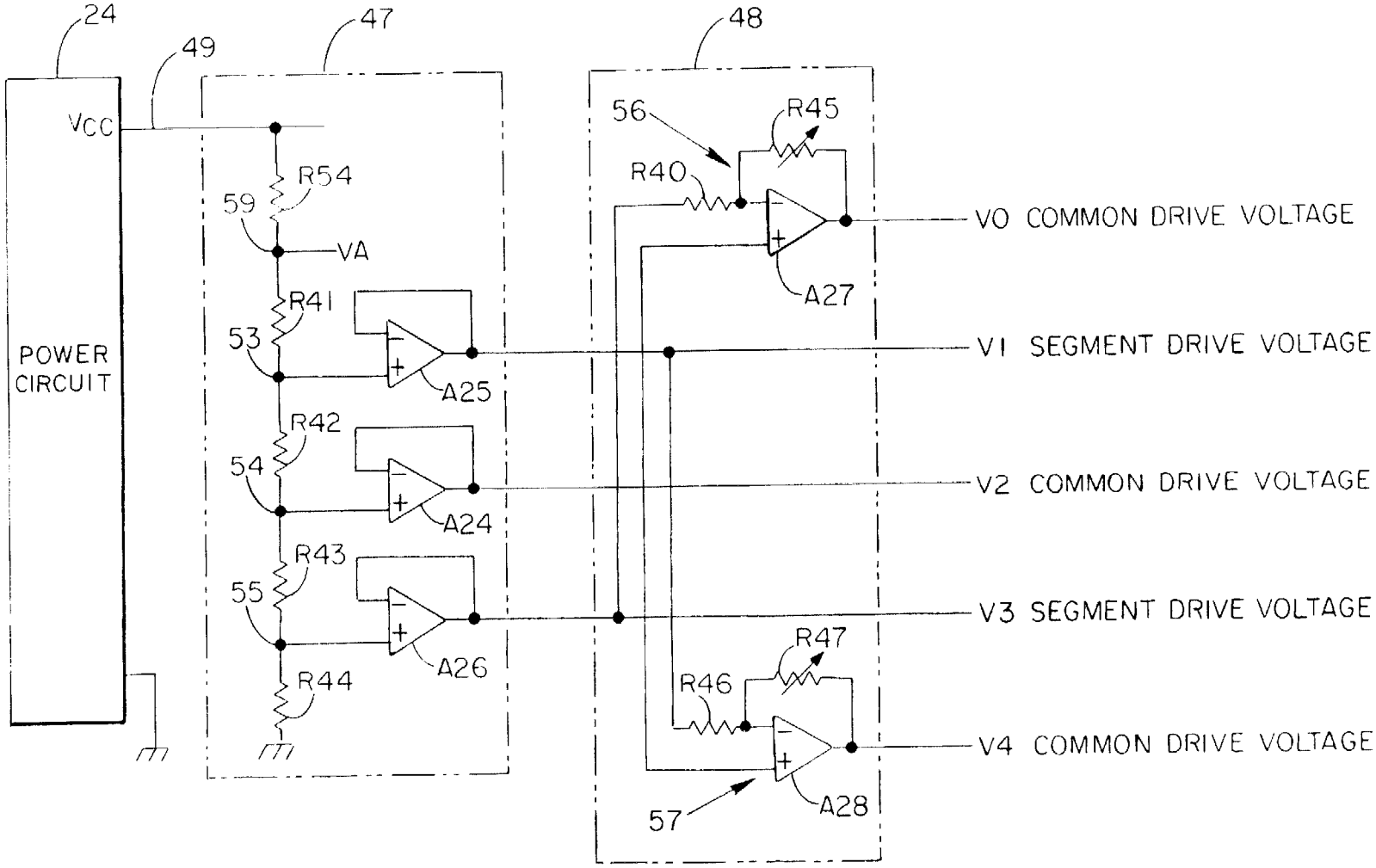
FIG. 15 is an electric circuit diagram showing a concrete construction of the power source 21C for driving a liquid crystal shown in FIG. 9 of still another embodiment of the invention.

FIG. 15 is an electric circuit diagram of the power source 21C for driving a liquid crystal of still another embodiment of the invention. This embodiment is similar to the embodiment shown in FIG. 10 and is given the same reference numerals for corresponding parts. What is to be noted is that, in this embodiment, the current source 50 and the reference voltage source 51 shown in FIG. 10 are omitted and that the output voltage Vcc from the power circuit 24 is further divided by using a resistor R54 to provide reference voltage VA from a connection 59 of the dividing resistors R41 to R44. This reference voltage VA is divided by the dividing resistors R41 to R44 to provide the voltages V0 to V4 in the same way as in the embodiment described before. This construction has an advantage of simplifying the construction.

Figure 16:
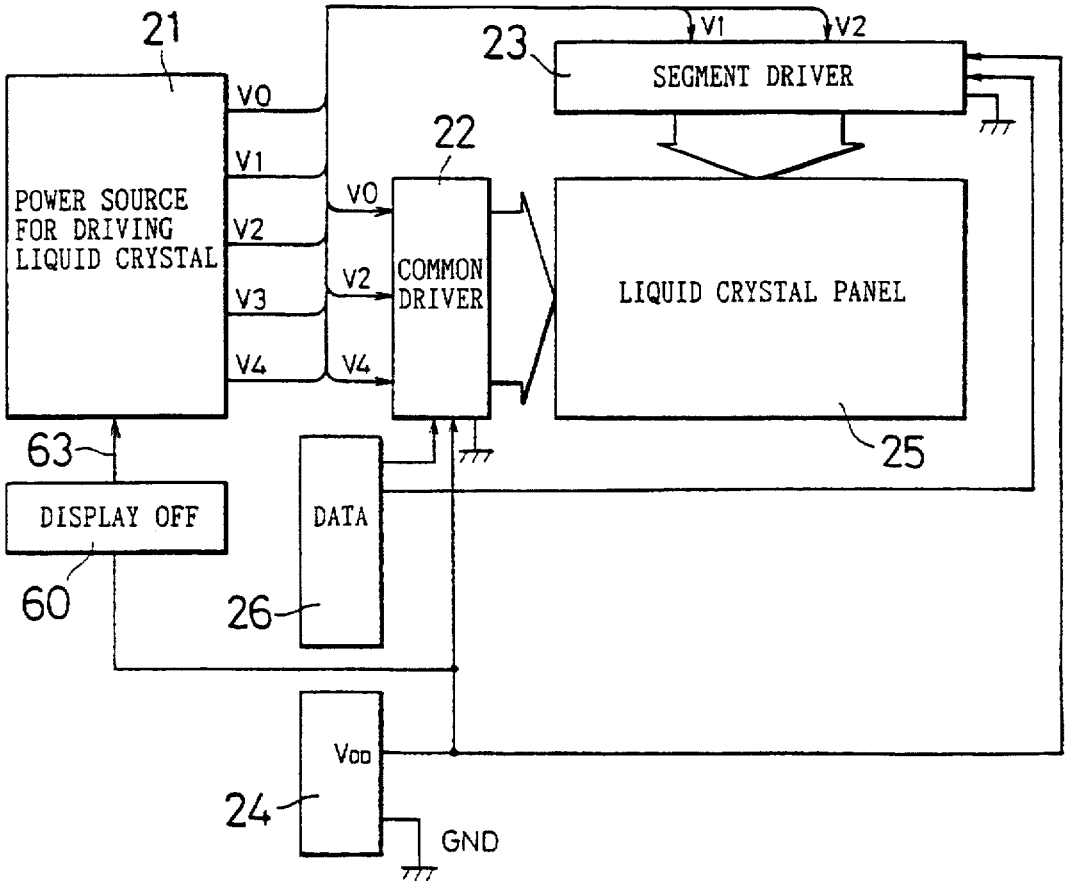
FIG. 16 is a block diagram showing a general construction of a liquid crystal display of other embodiment of the invention.

FIG. 16 is a block diagram showing the general construction of the liquid crystal display including the power source 21 for driving a liquid crystal of yet another embodiment of the invention. This embodiment is similar to the embodiment shown in FIG. 1 and is given the same reference numerals for corresponding parts. In this embodiment, a signal generating circuit 60 for turning off display is provided for the purpose of shutting off the display of the liquid panel 25.

Figure 17:
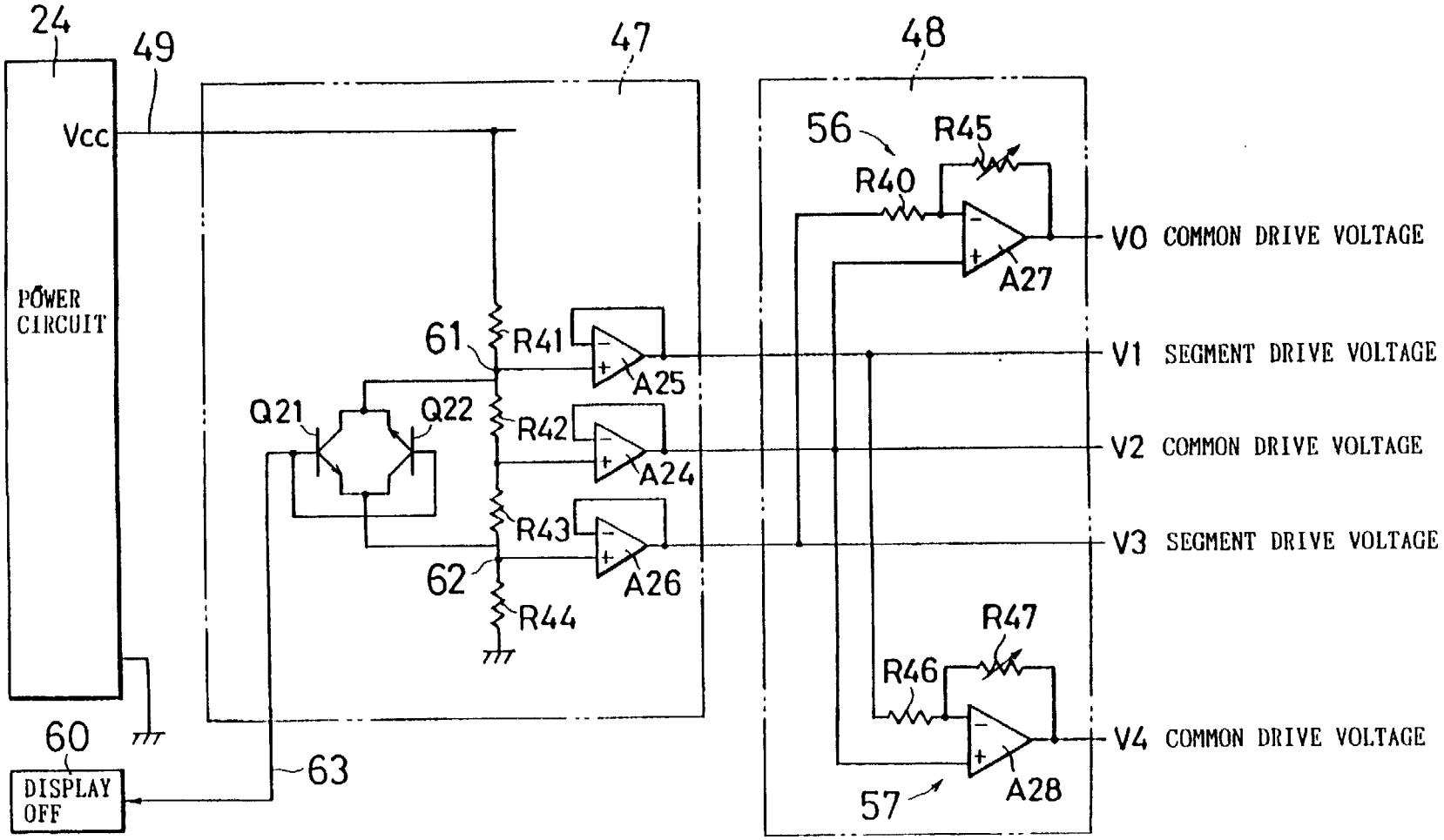
FIG. 17 is an electric circuit diagram showing a concrete construction of the power source 21 for driving a liquid crystal shown in FIG. 16.

FIG. 17 is an electric circuit diagram showing the concrete construction of the power source 21 for driving a liquid crystal shown in FIG. 16. This embodiment is similar to the embodiment shown in FIG. 15 and is given the same reference numerals for corresponding parts. In this embodiment, transistors Q21, Q22, which are switching means, are connected between connections 61, 62 of the dividing resistors R41 to R44 corresponding to the first and second segment voltages V1, V3. Those transistors Q21, Q22 are energized by display off signal from the signal generating circuit 60 for turning off display through a line 63. As transistors Q21, Q22 are energized, the connections 61, 62 are short-circuited. Therefore, $$V1=V2=V3 \tag{17}$$

This also makes the first and second common voltages V0, V4, which are output voltages of the differential amplifiers 56, 57, identical to the value of the central common voltage V2. In other words, the respective voltages V0 to V4 are all equal to one and the same central common voltage V2. This enables achievement of an excellent effect of turning off the display of the display panel 25 by putting it at rest and reducing its power consumption to almost zero. Other parts of the construction are identical with that of the previously described embodiment.

Figure 18:
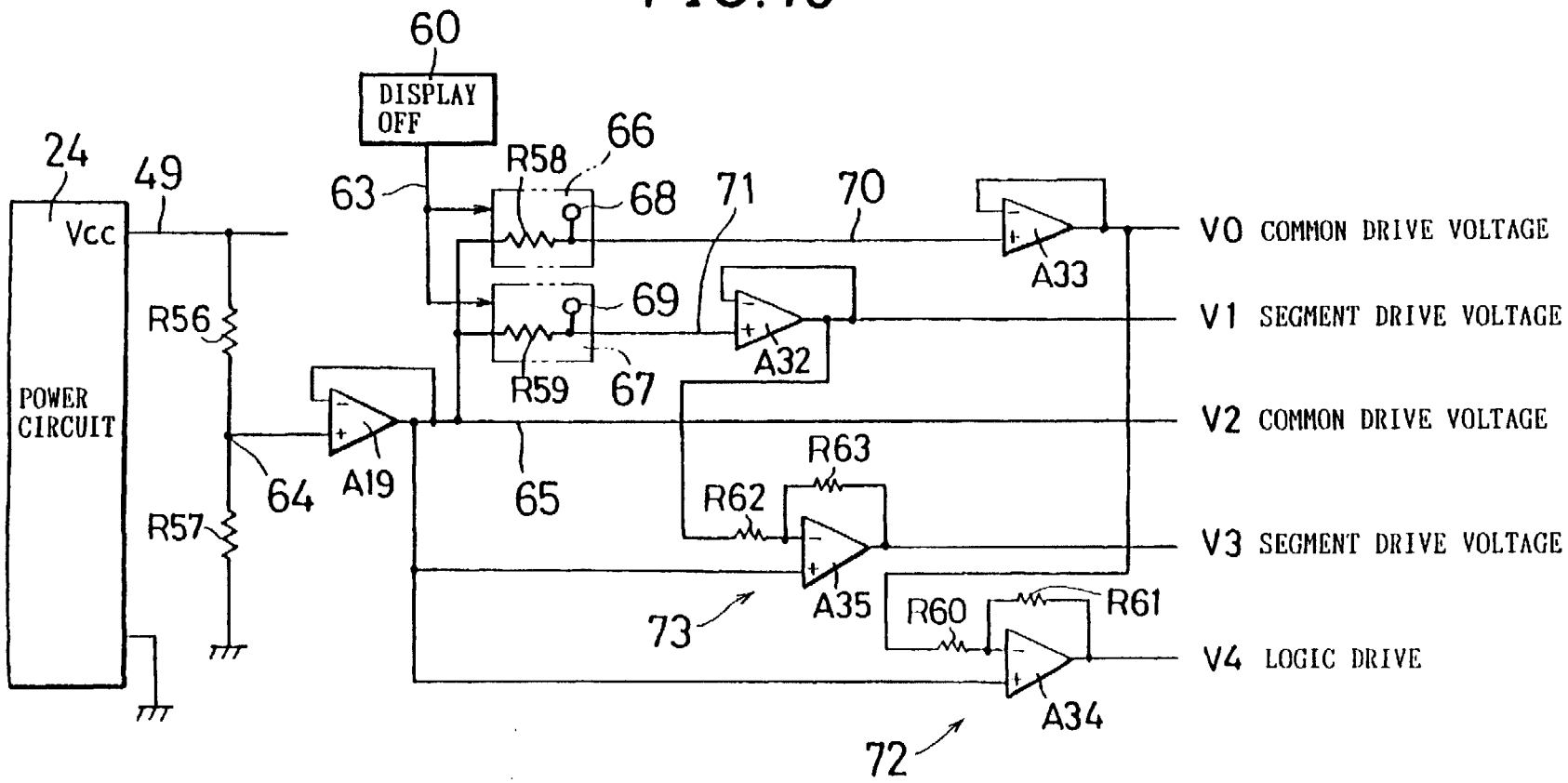
FIG. 18 is an electric circuit diagram showing a concrete construction of the power source 21 for driving a liquid crystal shown in FIG. 16 of still another embodiment of the invention.

FIG. 18 is an electric circuit diagram showing the concrete construction of the power source 21 for driving a liquid crystal of the embodiment of the invention shown in FIG. 16. The output voltage Vcc from the power circuit 24 is given to dividing resistors R56, R57 through the line 49, and a voltage is delivered from a connection 64 through the operational amplifier A19 to provide the central common voltage V2. A line 65 through which this central common voltage V2 is obtained is also led to a variable voltage circuit 66 for segment electrodes and a variable voltage circuit 67 for common electrodes. The respective variable voltage circuits 66, 67 comprise reference current circuits 68, 69 with variable current. Resistors R58, R59 are connected between the line 65 and the reference current sources 68, and between the line 65 and the reference current source 69, respectively, thereby changing the reference currents to change the voltages of lines 70, 71. The voltage delivered on the line 70 from the variable voltage circuit 66 is used as first common voltage V0 through an operational amplifier A33. The voltage delivered on the line 71 from another variable voltage circuit 67 is used as the first segment voltage V1 through an operational amplifier A32.

A differential amplifier 72 is given the central common voltage V2 from the line 65 and the first common voltage V0 from the operational amplifier A33, and generates the second common voltage V4 corresponding to the difference between the two, (V2–V0). This differential amplifier 72 is realized with an operational amplifier A34 and resistors R60, R61.

The central common voltage V2 and the first segment voltage V1 on the line 65 are supplied to a differential amplifier 73, and thereby the second segment voltage V3 corresponding to the difference therebetween is obtained. The differential amplifier 73 is realized by the operational amplifier A35 and the resistors R62, R63.

Figure 19:
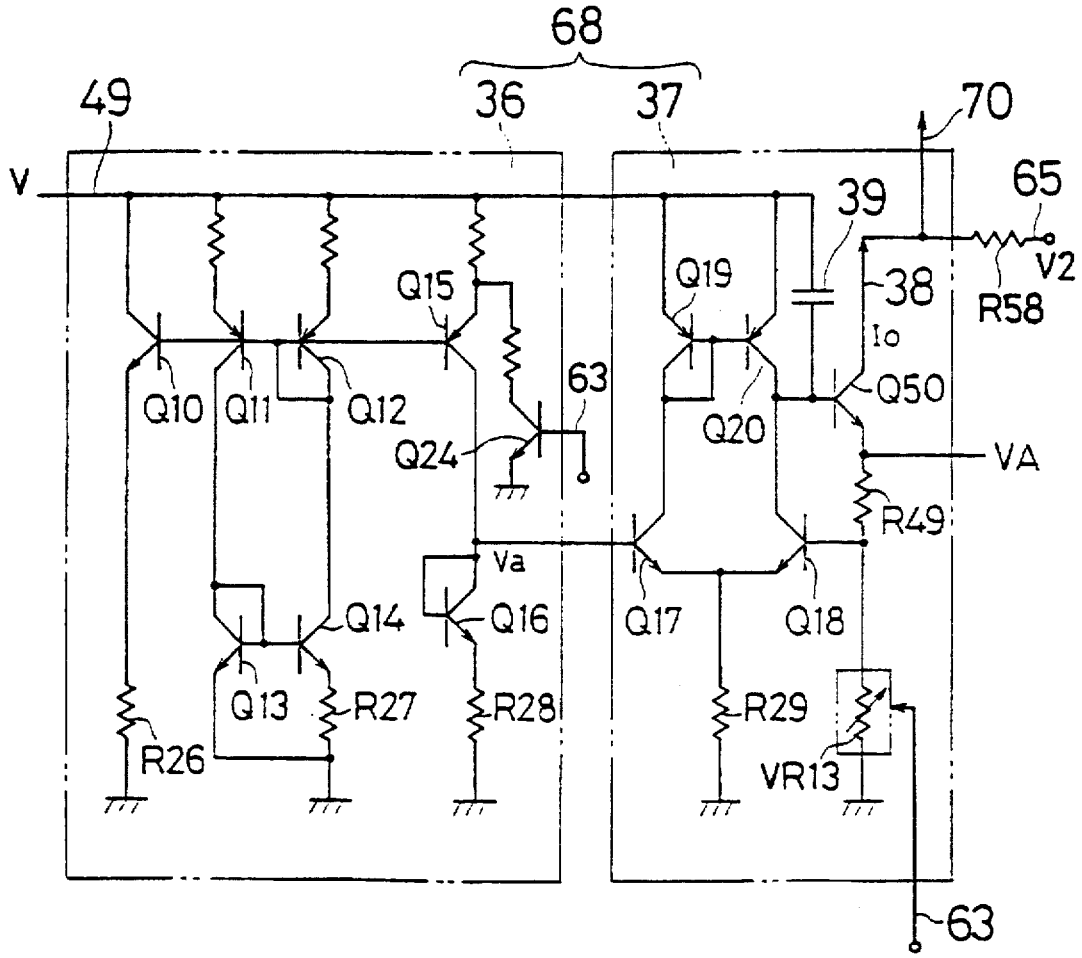
FIG. 19 is an electric circuit diagram showing a concrete construction of a variable voltage circuit 66 shown in FIG. 18.

FIG. 19 is an electric circuit diagram showing the concrete construction of the variable voltage circuit 66 shown in FIG. 18. This variable voltage circuit 66 is similar to the embodiment Shown in FIG. 6. and is given the same reference numerals for corresponding parts. What is to be noted in that, in this embodiment, the reference current source 68 comprises a band-gap constant voltage source 36 and a differential circuit 37 in the same way as the construction of FIG. 6 described earlier. The line 38 is connected to the line 65 to which the central common voltage V2 is given through the resistor R58. In this way, the first common voltage V0 is outputted on the line 70 in correspondence to the voltage at both ends of the resistor R58 which is dependent on the current I0.

The differential circuit 37 is an operational amplifier and delivers the output of voltage follower in current. The transistors Q17 and Q18 form a pair of differential inputs, and the base of the transistor Q17 becomes a non-inverted input and the base of the transistor Q18 becomes an inverted input to constitute a voltage follower circuit to feed back the output to the base of the transistor Q18 through the transistor Q20. Namely, the voltage at the base of the transistor Q18 also becomes Va. Therefore, the voltage Va is applied to both ends of the resistor VR13 and the output current 10 determined here is outputted through the transistor Q50.

The following equations are obtained:

$$I0 = \frac{Va}{VR13} \tag{18}$$

$$\text{Output voltage } V0 = I0 \times R58 + V2 = \frac{R58}{VR13}\ Va + V2 \tag{19}$$

and any change in the resistor VR13 also makes the output voltage change with reference to the voltage V2.

The display off signal from the signal generating circuit 60 for turning off display is given to the resistor VR13 trough the line 63. To turn off the display of the display panel 25 with this signal, (this signal circuit 60) is opened with the resistance value of the resistor VR13 infinite i.e. in the off state. This reduces the output current I0 to zero and the central common voltage V2 becomes equal to the first common voltage V0.

As still another embodiment of the invention, a switching transistor Q24 for conducting/shutting off the output transistor Q15 of the reference voltage circuit 36 is provided to reduce the current 10 to zero. To the base of this transistor Q24, display off signal from the signal generating circuit 60 for turning off display is given through the line 63. To thereby turn off the display of the display panel 25, the output, transistor Q15 is shut off to reduce the output voltage Va to zero, i.e. to the ground voltage GND level. This makes the current I0 of the differential circuit 37 zero and equalizes the first common voltage V0 with the central common voltage V2 in the same way as above. As a result, the-second-common voltage V4 also becomes equal to the central common voltage V2.

Another variable voltage circuit 67 also has a construction similar to that of the-variable voltage circuit 66, and this makes the first; and second segment voltages V1, V3 identical to the central, common voltage V2 when the display is turned off.

Figure 20:
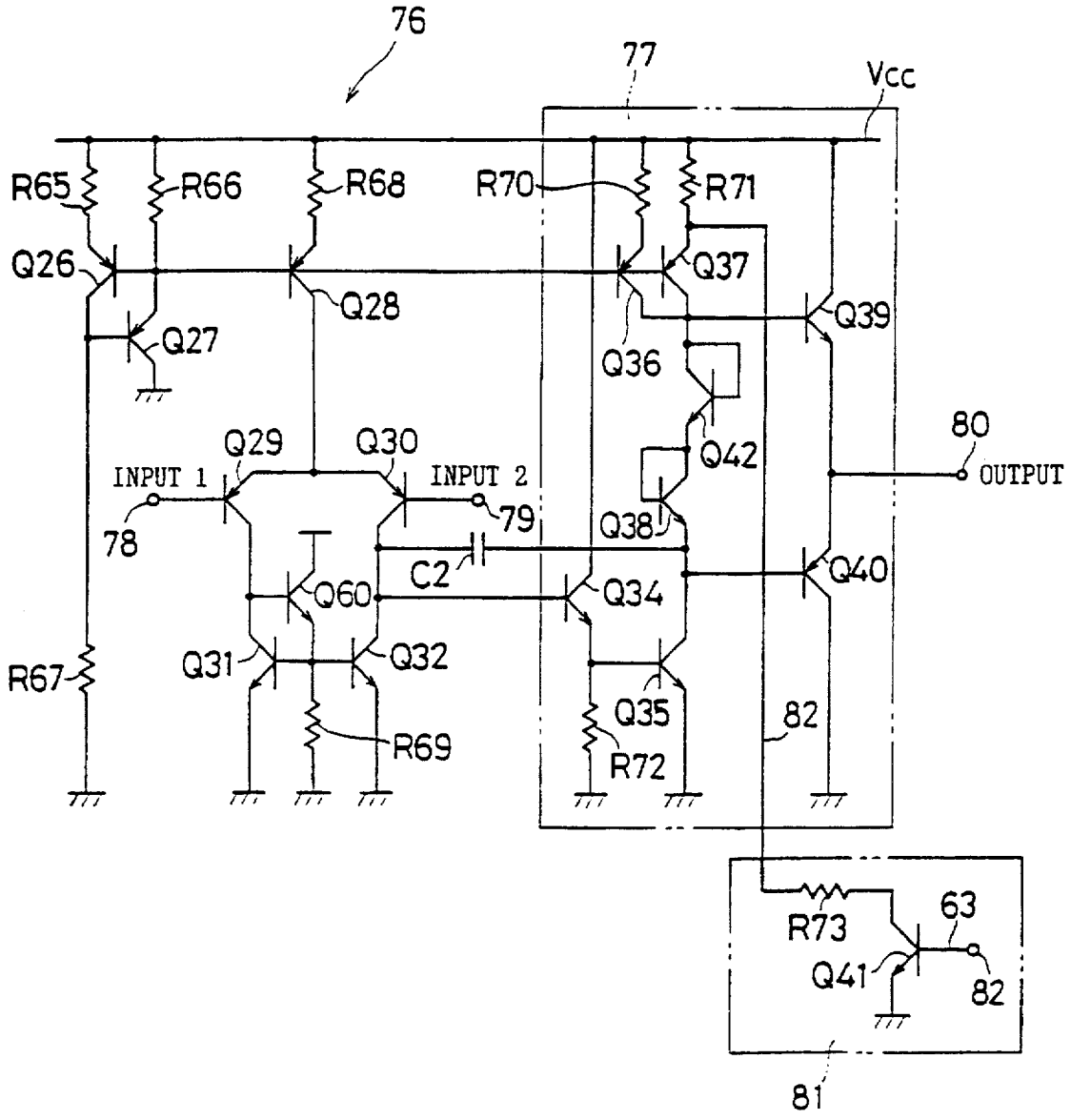
FIG. 20 is an electric circuit diagram showing a concrete construction of operational amplifiers A11 to A34 used in the invention.
Figure 21:
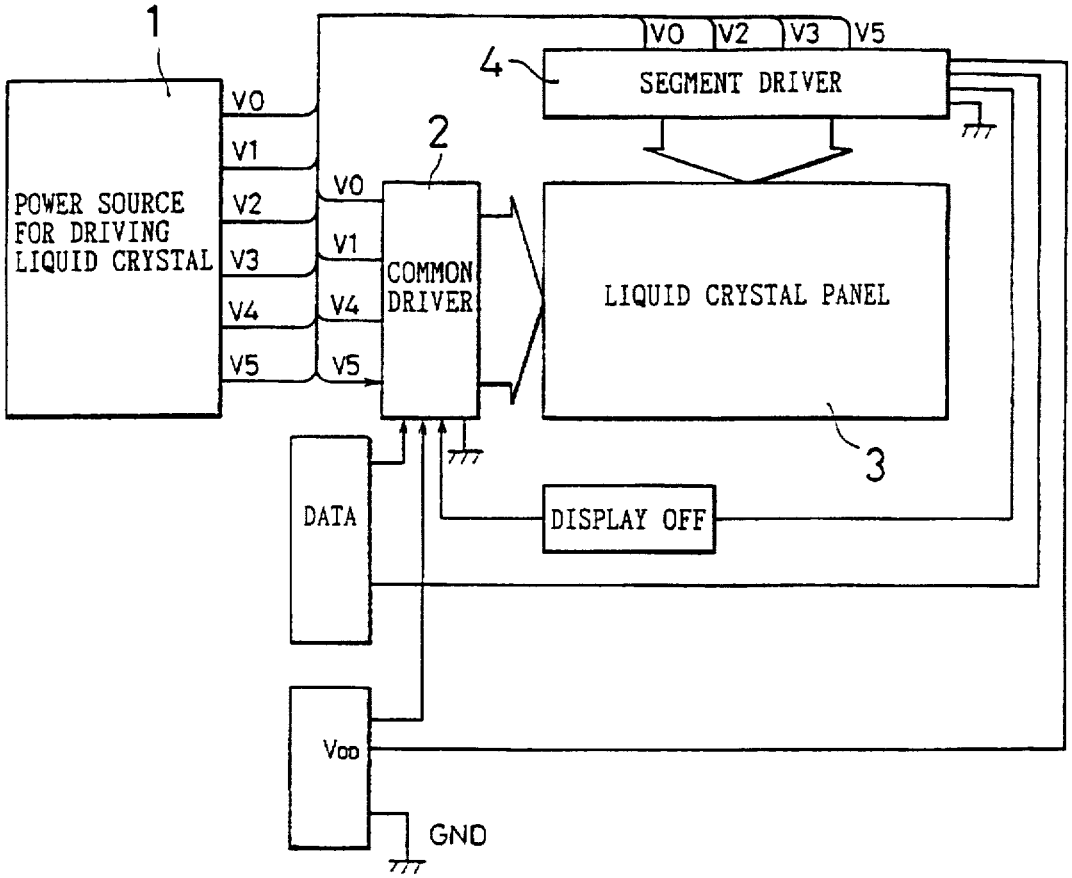
FIG. 21 PRIOR ART
FIG. 21 is a block diagram showing a general construction of a liquid crystal display of the prior art.
Figure 22:
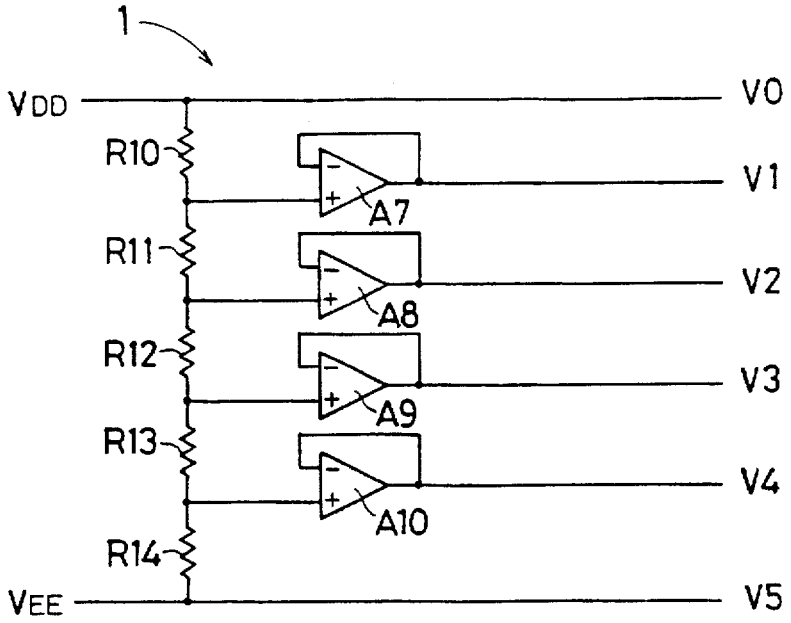
FIG. 22 PRIOR ART
FIG. 22 is an electric circuit diagram showing a concrete construction of a power source I for driving a liquid crystal in the prior art shown in FIG. 21.
Figure 23:
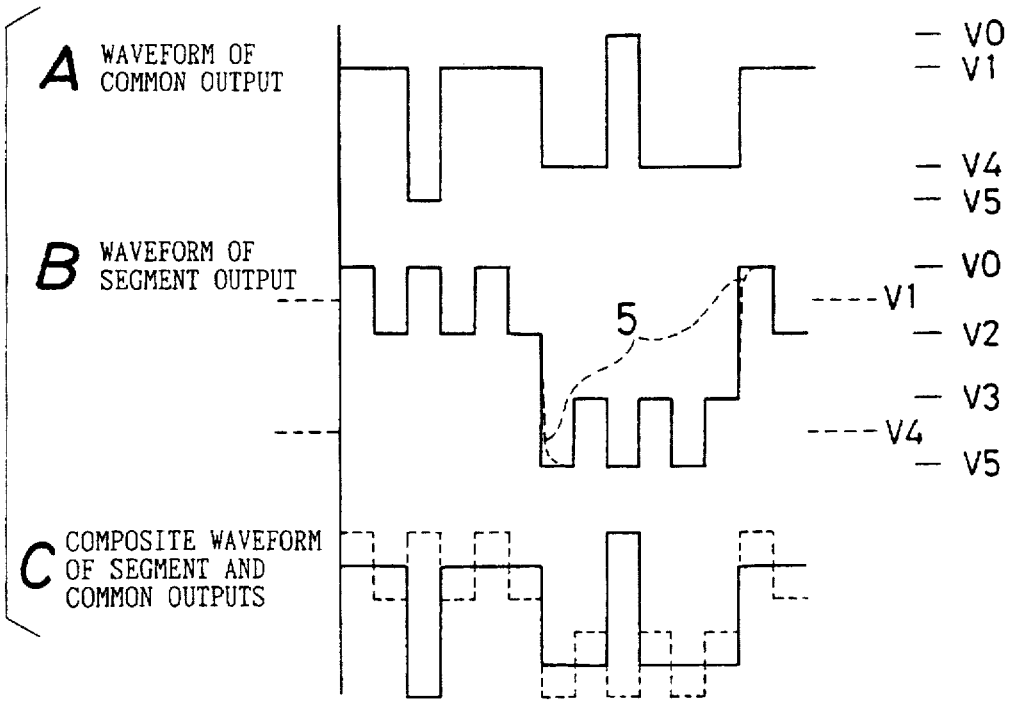
FIG. 23 PRIOR ART
FIGS. 23A, 23B, 23C are drawings showing waveforms of a voltage given to a liquid crystal panel of the prior art shown in FIG. 21 and FIG. 22.
Figure 24:
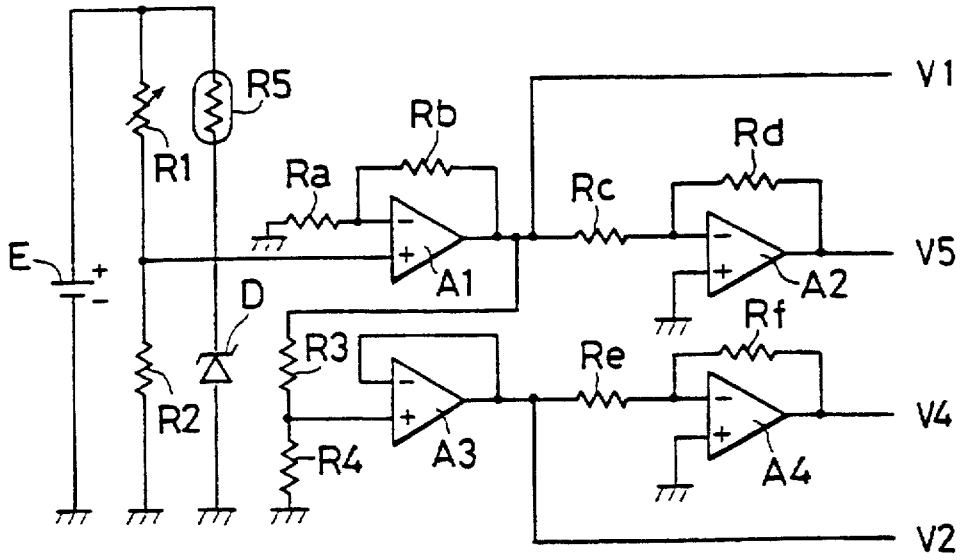
FIG. 24 PRIOR ART
FIG. 24 is an electric circuit diagram of the power source 1 for driving a liquid crystal of another prior art.
Figure 25:
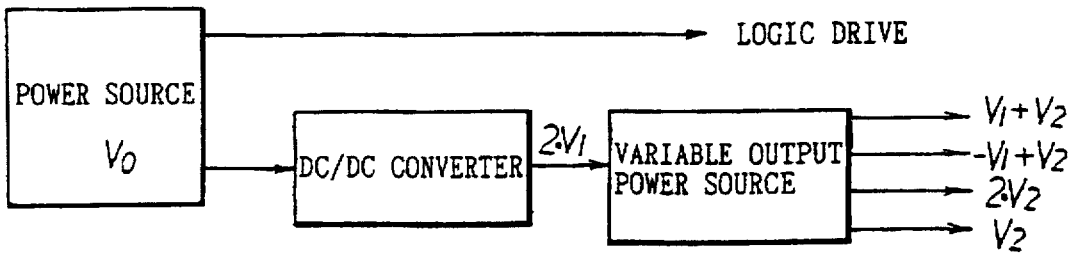
FIG. 25 PRIOR ART
FIG. 25 is a block diagram showing a construction of still another prior art;.
Figure 26:
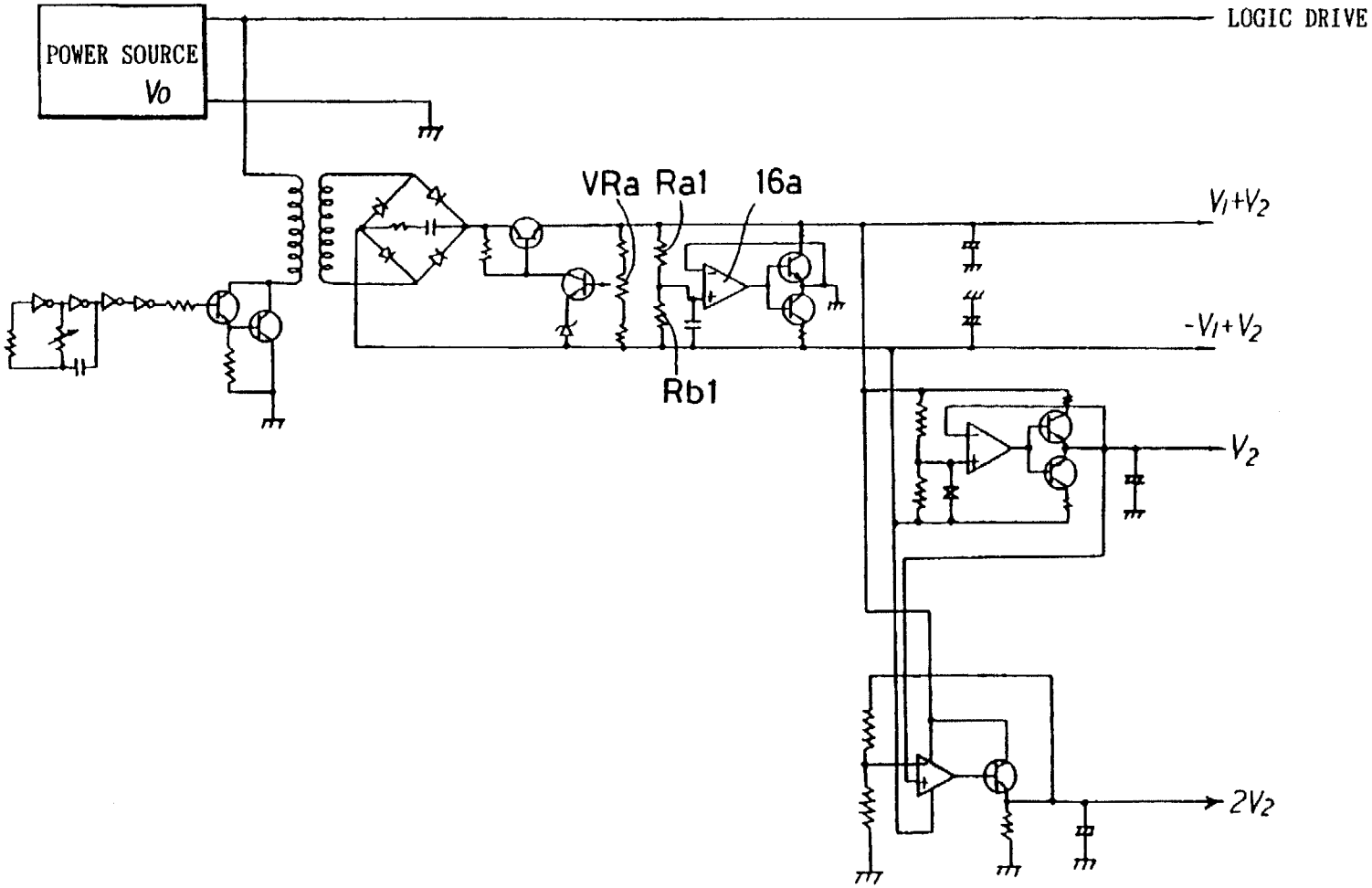
FIG. 26 is an electric circuit diagram showing a concrete construction of the prior art shown in FIG. 25.
Figure 27:
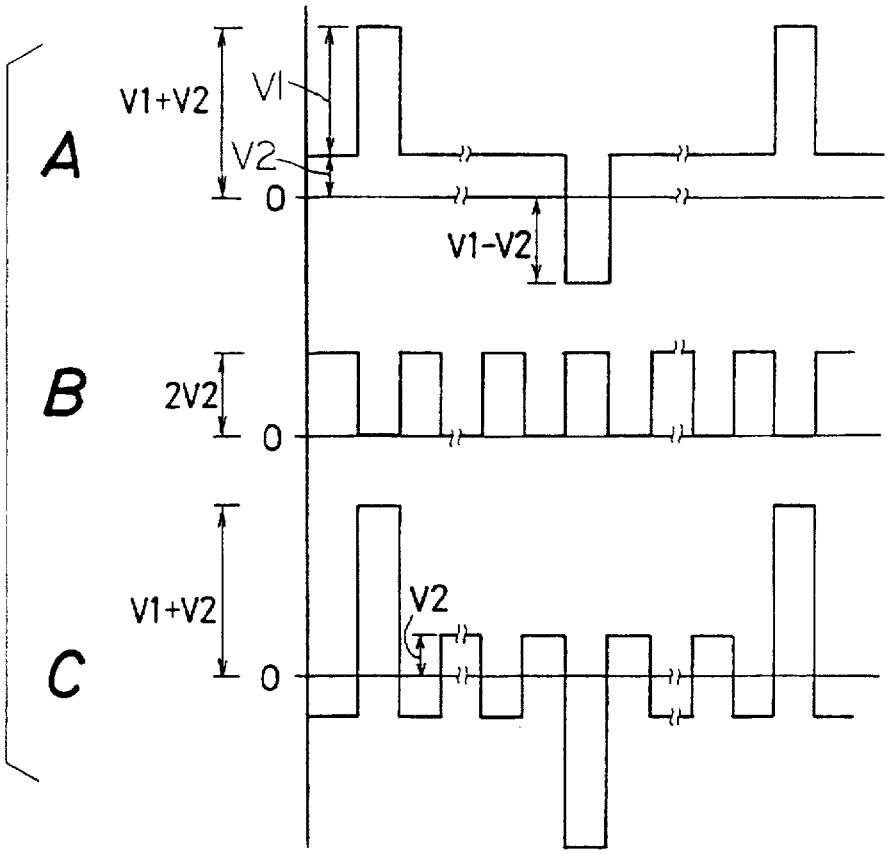
FIGS. 27A, 27B, 27C are drawings showing waveforms of a voltage given to a liquid crystal of the prior art shown in FIG. 25 and FIG. 26.
Figure 28:
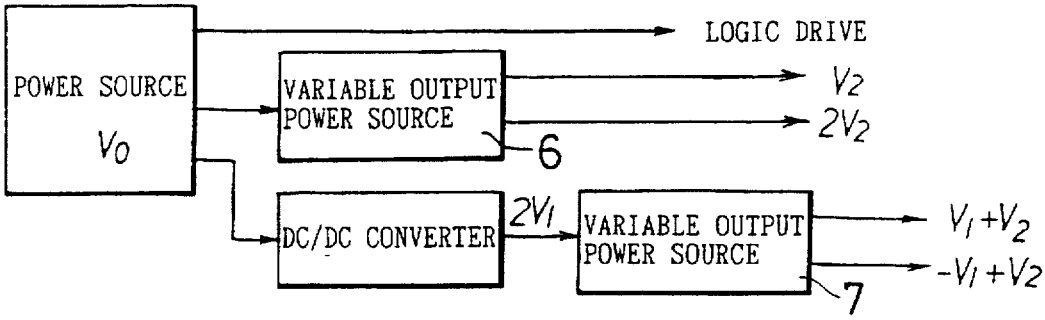
FIG. 28 is a block diagram showing a construction of yet another prior art.
Figure 29:
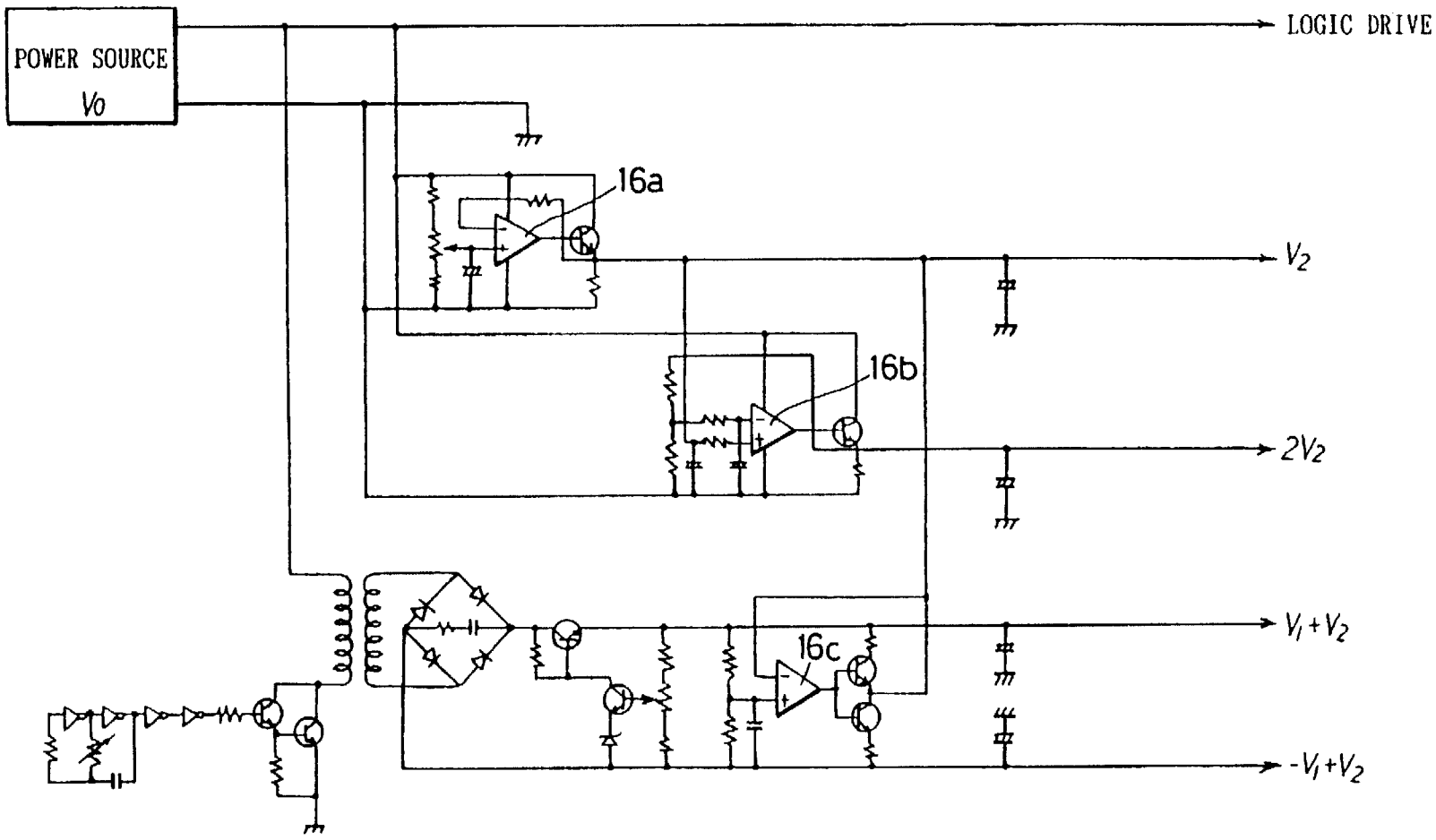
FIG. 29 is an electric circuit diagram showing a concrete electric construction of the prior art shown in FIG. 28.

FIG. 20 is an electric circuit diagram showing the concrete construction of the operational amplifiers A11 to A34 used in the invention. These operational amplifiers comprise a differential circuit 76 and a output circuit 77. The differential circuit 76 comprises transistors Q26 to Q32 and resistors R65 to E69 and has two input terminals 78, 79. The output circuit 77 is provided with transistors Q34 to Q40, Q42 and is also provided with resistors R70 to R72. It also has a capacitor C2. An output terminal 80 of the output circuit 77 is connected to the output transistors Q39, Q40 and, to the transistor Q37 for operating those transistors Q39, Q40, a switching circuit 81 for reducing power consumption is connected through a line 82. The switching circuit 81 comprises a transistor Q41 and a resistor R73. When turning off the display of the liquid crystal panel 25, a stop signal is led-to the switching transistor Q41 through the line 82 to shut off the transistor Q37. This mares it possible to reduce the current of the output circuit 77 and economize power consumption .

This construction of FIG. 20 is an example of reducing the current at the output unit of the operational amplifier, in which the transistor Q37 of the constant current circuit supplying a base current for output source current is controlled from outside to be cut off. It is often the case that the operational amplifier for driving a liquid crystal increases the current at the output unit to accelerate the charging and discharging to the load (liquid crystal panel). Because there is no need of such current capacity when the display is turned off, the transistor Q41 is turned on from outside to cut off the transistor Q37 in such a case. As the transistor Q41 is turned on, the collector voltage of the transistor Q41 comes close to the GND level, and the emitter potential of the transistor Q37 becomes equal to the value obtained by dividing the potential between Vcc and GND with resistors R71 and R73. Here, reverse bias is applied between the base and the emitter of the transistor Q37 when the resistors R71 and R73 are set as desired, to produce a cut-off state. By setting; the current ratio of transistors Q36 to Q37 supplying the base current of the output transistors as I (Q37)>I (Q36), it becomes possible to reduce the current at the output unit by cutting off the transistor Q37. However, this in only an example, and the circuits 76 and 77 are circuits constituting a general type of operational amplifier.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come Within the meaning and the range of equivalency of the claims are therefore intended to be embraced therein.

What is claimed is:

1. A liquid crystal driving power source for a matrix type liquid crystal display in which a plurality of common electrodes and a plurality of segment electrodes are arranged in a way to cross each other through a liquid crystal, the liquid crystal driving power source comprising:

a common voltage source for generating common voltages to be applied to the plurality of common electrodes, the common voltage source generating a first common voltage V0 and a second common voltage V4 above and under a central common voltage V2, respectively;

a segment voltage source for generating segment voltages to be applied to the plurality of segment electrodes, the segment voltage source to which the central common voltage V2 is given and which generates a first segment voltage V1 and a second segment voltage V3 above and under the central common voltage V2, respectively, which do no exceed the first and second common voltages V0, V4; and means for varying said common voltages independently from said segment voltages.

2. The liquid crystal driving power source of claim 1, wherein the segment voltage source comprises:

a current source capable of supplying a predetermined constant current;

a resistor to one terminal of which the central common voltage V2 is supplied, and to the other terminal of which the current source is connected, the other terminal through which the first segment voltage V1 is output; and a differential amplifier wherein the central common voltage V2 is supplied, and the first segment voltage V1 is inverted to generate the second segment voltage V3.

3. The liquid crystal driving power source of claim 1, wherein the liquid crystal driving power source further comprises:

a dividing circuit connected to a power supply circuit which supplies a predetermined constant voltage, and in which a first resistor, a second resistor whose resistance is variable, and third resistors are arranged in series; and a differential amplifier having a gain of 1, wherein the central common voltage V2 and the first segment voltage V1 are supplied, and the first segment voltage V1 is inverted to generate the second segment voltage V3.

4. A liquid crystal driving power source for a matrix type liquid crystal display in which a plurality of common electrodes and a plurality of segment electrodes are arranged in a way to cross each other through a liquid crystal, the liquid crystal driving power source comprising:

a segment voltage source for generating voltages to be applied to the plurality of segment electrodes, the segment voltage source generating a first segment voltage V1 and a second segment voltage V3 above and under a central common voltage V2, respectively;

a common voltage source for generating voltages to be applied to the plurality of common electrodes, the common voltage source to which the central common voltage V2 is given and which generates a first common voltage V0 and a second common voltage V4 above and under the central common voltage V2, respectively, which exceed the first and second segment voltages V1, V3; and means for equalizing the first and second segment voltages V1, V3 with the central common voltage V2 when displaying is not carried out.

5. The liquid crystal driving power source of claim 4, wherein the common voltage source comprises:

a first differential amplifier generating the first common voltage V0 corresponding to the difference of the central common voltage V2 from one of the first and second segment voltages V1, V3, and a second differential amplifier generating the second common voltage V4 corresponding to the difference of the central common voltage V2 from the other of the first and second segment voltages V1, V3.

6. The liquid crystal driving power source of claim 4, wherein the segment voltage source comprises a constant current source supplying a predetermined constant current, a reference voltage source supplying a predetermined constant voltage, and a dividing circuit connected to the reference voltage source, in which a first resistor and a second resistor are arranged in series, the voltage output from the connection of one terminal of the first resistor and one terminal of the second resistor is used as the central common voltage V2, the voltage output from the other terminal of the first resistor is used as the first segment voltage V1, and the voltage output from the other terminal of the second resistor is used as the second segment voltage V3.

7. The liquid crystal driving power source of claim 4, wherein the common voltage source comprises:

a first differential amplifier having a gain exceeding 1, wherein the central common voltage V2 and the second segment voltage V3 are supplied, and the second segment voltage V3 is inverted to generate the first common voltage V0, and a second differential amplifier having a gain exceeding 1, wherein the central common voltage V2 and the first segment voltage V1 are supplied, and the first segment voltage V1 is inverted to generate the second common voltage V4.

8. The liquid crystal driving power source of claim 4, wherein the common voltage source comprises:

a first differential amplifier having a gain exceeding 1, wherein the central common voltage V2 and the first segment voltage V1 are supplied to generate the second common voltage V4, and a second differential amplifier having a gain of 1, wherein the central common voltage V2 and the second common voltage V4 are supplied, and the second common voltage V4 is inverted to generate the first common voltage V0.

9. The liquid crystal driving power source of claim 4, wherein the segment voltage source comprises a dividing circuit connected to a power source circuit supplying a predetermined constant voltage, in which a first resistor, a second resistor, a third resistor and a fourth resistor are arranged in series, the voltage output from the connection of the first resistor and the second resistor is used as the first segment voltage V1, the voltage output from the connection of the second resistor and the third resistor is used as the central common voltage V2, and the voltage output from the connection of the third resistor and the fourth resistor is used as the second segment voltage V3.

10. A liquid crystal driving power source for a matrix type liquid crystal display in which a plurality of common electrodes and a plurality of segment electrodes are arranged in a way to cross each other through a liquid crystal, the liquid crystal driving power source comprising:

means for generating a central common voltage V2 for the plurality of common electrodes, a current source capable of supplying a predetermined constant current and shutting off that current, means for generating a first common voltage V0, interposed between the means for generating the central common voltage and the current source, means for generating a first segment voltage V1, interposed between the means for generating the central common voltage and the power source, a first differential amplifier generating a second common voltage V4 corresponding to the difference between the central common voltage V2 and the first common voltage V0, a second differential amplifier generating a second segment voltage V3 corresponding to the difference between the central common voltage V2 and the first segment voltage V1, and means for shutting off the current source when displaying is not carried out.

11. The liquid crystal driving power source of claim 1, wherein the liquid crystal driving power source further comprises:

a dividing circuit connected to a power supply circuit which supplies a predetermined constant voltage, and in which a first resistor, a second resistor whose resistance is variable, and third resistors are arranged in series; and a differential amplifier, wherein the central common voltage V2 and a voltage output from said second resistor are supplied, and the voltage output from said second resistor is inverted to generate the second segment voltage V3.

12. A liquid crystal driving power source for a matrix type liquid crystal display in which a plurality of common electrodes and a plurality of segment electrodes are arranged in a way to cross each other through a liquid crystal, the liquid crystal driving power source comprising:

a common voltage source for generating common voltages to be applied to the plurality of common electrodes, the common voltage source generating a first common voltage V0 and a second common voltage V4 above and under a central common voltage V2, respectively; and a segment voltage source for generating segment voltages to be applied to the plurality of segment electrodes, the segment voltage source to which the central common voltage V2 is given and which generates a first segment voltage V1 and a second segment voltage V3 above and under the central common voltage V2, respectively, which do no exceed the first and second common voltages V0, V4, wherein said segment voltage source includes a current source capable of supplying a predetermined constant current, a resistor to one terminal of which the central common voltage V2 is supplied, and to the other terminal of which the current source is connected, the other terminal through which the first segment voltage V1 is output, and a differential amplifier wherein the central common voltage V2 is supplied, and the first segment voltage V1 is inverted to generate the second segment voltage V3.

13. A liquid crystal driving power source for a matrix type liquid crystal display in which a plurality of common electrodes and a plurality of segment electrodes are arranged in a way to cross each other through a liquid crystal, the liquid crystal driving power source comprising:

a common voltage source for generating common voltages to be applied to the plurality of common electrodes, the common voltage source generating a first common voltage V0 and a second common voltage V4 above and under a central common voltage V2, respectively;

a segment voltage source for generating segment voltages to be applied to the plurality of segment electrodes, the segment voltage source to which the central common voltage V2 is given and which generates a first segment voltage V1 and a second segment voltage V3 above and under the central common voltage V2, respectively, which do no exceed the first and second common voltages V0, V4;

a dividing circuit connected to a power supply circuit which supplies a predetermined constant voltage, and in which a first resistor, a second resistor whose resistance is variable, and third resistors are arranged in series; and a differential amplifier having a gain of 1, wherein the central common voltage V2 and the first segment voltage V1 are supplied, and the first segment voltage V1 is inverted to generate the second segment voltage V3.

14. A liquid crystal driving power source for a matrix type liquid crystal display in which a plurality of common electrodes and a plurality of segment electrodes are arranged in a way to cross each other through a liquid crystal, the liquid crystal driving power source comprising:

a segment voltage source for generating voltages to be applied to the plurality of segment electrodes, the segment voltage source generating a first segment voltage V1 and a second segment voltage V3 above and under a central common voltage V2, respectively; and a common voltage source for generating voltages to be applied to the plurality of common electrodes, the common voltage source to which the central common voltage V2 is given and which generates a first common voltage V0 and a second common voltage V4 above and under the central common voltage V2, respectively, which exceed the first and second segment voltages V1, V3, the common voltage source including a first differential amplifier generating the first common voltage V0 corresponding to the difference of the central common voltage V2 from one of the first and second segment voltages V1, V3, and a second differential amplifier generating the second common voltage V4 corresponding to the difference of the central common voltage V2 from the other of the first and second segment voltages V1, V3.

15. A liquid crystal driving power source for a matrix type liquid crystal display in which a plurality of common electrodes and a plurality of segment electrodes are arranged in a way to cross each other through a liquid crystal, the liquid crystal driving power source comprising:

a segment voltage source for generating voltages to be applied to the plurality of segment electrodes, the segment voltage source generating a first segment voltage V1 and a second segment voltage V3 above and under a central common voltage V2, respectively, the segment voltage source including a constant current source supplying a predetermined constant current, a reference voltage source supplying a predetermined constant voltage, and a dividing circuit connected to the reference voltage source, in which a first resistor and a second resistor are arranged in series, the voltage output from the connection of one terminal of the first resistor and one terminal of the second resistor is used as the central common voltage V2, the voltage output from the other terminal of the first resistor is used as the first segment voltage V1, and the voltage output from the other terminal of the second resistor is used as the second segment voltage V3; and a common voltage source for generating voltages to be applied to the plurality of common electrodes, the common voltage source to which the central common voltage V2 is given and which generates a first common voltage V0 and a second common voltage V4 above and under the central common voltage V2, respectively, which exceed the first and second segment voltages V1, V3.

16. A liquid crystal driving power source for a matrix type liquid crystal display in which a plurality of common electrodes and a plurality of segment electrodes are arranged in a way to cross each other through a liquid crystal, the liquid crystal driving power source comprising:

a segment voltage source for generating voltages to be applied to the plurality of segment electrodes, the segment voltage source generating a first segment voltage V1 and a second segment voltage V3 above and under a central common voltage V2, respectively; and a common voltage source for generating voltages to be applied to the plurality of common electrodes, the common voltage source to which the central common voltage V2 is given and which generates a first common voltage V0 and a second common voltage V4 above and under the central common voltage V2, respectively, which exceed the first and second segment voltages V1, V3, the common voltage source including a first differential amplifier having a gain exceeding 1, wherein the central common voltage V2 and the second segment voltage V3 are supplied, and the second segment voltage V3 is inverted to generate the first common voltage V0, and a second differential amplifier having a gain exceeding 1, wherein the central common voltage V2 and the first segment voltage V1 are supplied, and the first segment voltage V1 is inverted to generate the second common voltage V4.

17. A method for driving a matrix type liquid crystal display in which a plurality of common electrodes and a plurality of segment electrodes are arranged in a way to cross each other through a liquid crystal, comprising the steps of:

generating common voltages to be applied to the plurality of common electrodes, including generating a first common voltage V0 and a second common voltage V4 above and under a central common voltage V2, respectively;

generating segment voltages to be applied to the plurality of segment electrodes, including generating a first segment voltage V1 and a second segment voltage V3 above and under the central common voltage V2, respectively, which do no exceed the first and second common voltages V0, V4; and varying said common voltages independently from said segment voltages.

18. The method of claim 17, wherein the step of generating segment voltages further includes:

supplying a predetermined constant current;

supplying the common central voltage V2 to one terminal of a resistor to one terminal and supplying a predetermine constant current to another terminal of the resistor;

outputting first segment voltage V1 from the another terminal of the resistor; and inverting the first segment voltage around the central common voltage V2 to generate the second segment voltage V3.

19. The method of claim 17, further comprising:

connecting a dividing circuit to a power supply circuit which supplies a predetermined constant voltage, and in which a first resistor, a second resistor whose resistance is variable, and third resistors are arranged in series;

supplying the central common voltage V2 and the first segment voltage V1 to a differential amplifier having a gain of 1; and inverting the first segment voltage V1 via the differential amplifier to generate the second segment voltage V3 via the differential amplifier.

20. The method of claim 17, further comprising:

connecting a dividing circuit to a power supply circuit which supplies a predetermined constant voltage, and in which a first resistor, a second resistor whose resistance is variable, and third resistors are arranged in series; and supplying the central common voltage V2 and a voltage output from said second resistor to a differential amplifier, and inverting the voltage output from said second resistor to generate the second segment voltage V3 via the differential amplifier.

21. A method for driving a matrix type liquid crystal display in which a plurality of common electrodes and a plurality of segment electrodes are arranged in a way to cross each other through a liquid crystal, comprising the steps of:

generating common voltages to be applied to the plurality of common electrodes, including generating a first common voltage V0 and a second common voltage V4 above and under a central common voltage V2, respectively; and generating segment voltages to be applied to the plurality of segment electrodes, including generating a first segment voltage V1 and a second segment voltage V3 above and under the central common voltage V2, respectively, which do no exceed the first and second common voltages V0, V4, said step of generating including supplying a predetermined constant current, supplying the common central voltage V2 to one terminal of a resistor to one terminal and supplying a predetermine constant current to another terminal of the resistor, outputting first segment voltage V1 from the another terminal of the resistor, and inverting the first segment voltage around the central common voltage V2 to generate the second segment voltage V3.

22. A method for driving a matrix type liquid crystal display in which a plurality of common electrodes and a plurality of segment electrodes are arranged in a way to cross each other through a liquid crystal, comprising the steps of:

generating common voltages to be applied to the plurality of common electrodes, including generating a first common voltage V0 and a second common voltage V4 above and under a central common voltage V2, respectively; and generating segment voltages to be applied to the plurality of segment electrodes, including generating a first segment voltage V1 and a second segment voltage V3 above and under the central common voltage V2, respectively, which do no exceed the first and second common voltages V0, V4, said step of generating including connecting a dividing circuit to a power supply circuit which supplies a predetermined constant voltage, and in which a first resistor, a second resistor whose resistance is variable, and third resistors are arranged in series, supplying the central common voltage V2 and the first segment voltage V1 to a differential amplifier having a gain of 1, and inverting the first segment voltage V1 via the differential amplifier to generate the second segment voltage V3 via the differential amplifier.

23. A method for driving a matrix type liquid crystal display in which a plurality of common electrodes and a plurality of segment electrodes are arranged in a way to cross each other through a liquid crystal, comprising the steps of:

generating segment voltages to be applied to the plurality of segment electrodes, including generating a first segment voltage V1 and a second segment voltage V3 above and under a central common voltage V2, respectively;

generating common voltages to be applied to the plurality of common electrodes, including generating a first common voltage V0 and a second common voltage V4 above and under the central common voltage V2, respectively, which exceed the first and second segment voltages V1, V3; and equalizing the first and second segment voltages V1, V3 with the central common voltage V2 when displaying is not carried out.

24. The method of claim 23, wherein the step of generating common voltages further includes:

generating the first common voltage V0 corresponding to the difference of the central common voltage V2 from one of the first and second segment voltages V1, V3, and generating the second common voltage V4 corresponding to the difference of the central common voltage V2 from the other of the first and second segment voltages V1, V3.

25. The method of claim 23, wherein the step of generating segment voltages includes supplying a predetermined constant voltage to a dividing circuit, in which a first resistor and a second resistor are arranged in series, using the voltage output from the connection of one terminal of the first resistor and one terminal of the second resistor as the central common voltage V2, using the voltage output from the other terminal of the first resistor as the first segment voltage V1, and using the voltage output from the other terminal of the second resistor is used as the second segment voltage V3.

26. The method of claim 23, wherein the step of generating common voltages further includes:

supplying the central common voltage V2 and the second segment voltage V3 to a first differential amplifier having a gain exceeding 1, and inverting the second segment voltage V3 to generate the first common voltage V0, and supplying the central common voltage V2 and the first segment voltage V1 to a second differential amplifier having a gain exceeding 1, and inverting the first segment voltage V1 to generate the second common voltage V4.

27. The method of claim 23, wherein the step of generating common voltages includes:

supplying the central common voltage V2 and the first segment voltage V1 to a first differential amplifier having a gain exceeding 1, to generate the second common voltage V4, and supplying the central common voltage V2 and the second common voltage V4 to a second differential amplifier having a gain of 1, and inverting the second common voltage V4 to generate the first common voltage V0.

28. The method of claim 23, wherein the step of generating segment voltages includes connecting a dividing circuit to a power source circuit supplying a predetermined constant voltage, in which a first resistor, a second resistor, a third resistor and a fourth resistor are arranged in series, outputting the voltage from the connection of the first resistor and the second resistor as the first segment voltage V1, outputting the voltage from the connection of the second resistor and the third resistor as the central common voltage V, and outputting the voltage from the connection of the third resistor and the fourth resistor as the second segment voltage V3.

29. A method for driving a matrix type liquid crystal display in which a plurality of common electrodes and a plurality of segment electrodes are arranged in a way to cross each other through a liquid crystal, comprising the steps of:

generating segment voltages to be applied to the plurality of segment electrodes, including generating a first segment voltage V1 and a second segment voltage V3 above and under a central common voltage V2, respectively; and generating common voltages to be applied to the plurality of common electrodes, including generating a first common voltage V0 and a second common voltage V4 above and under the central common voltage V2, respectively, which exceed the first and second segment voltages V1, V3, the step of generating common voltages including supplying the central common voltage V2 and the first segment voltage V1 to a first differential amplifier having a gain exceeding 1, to generate the second common voltage V4, and supplying the central common voltage V2 and the second common voltage V4 to a second differential amplifier having a gain of 1, and inverting the second common voltage V4 to generate the first common voltage V0.

30. A method for driving a matrix type liquid crystal display in which a plurality of common electrodes and a plurality of segment electrodes are arranged in a way to cross each other through a liquid crystal, comprising the steps of:

generating segment voltages to be applied to the plurality of segment electrodes, including generating a first segment voltage V1 and a second segment voltage V3 above and under a central common voltage V2, respectively; and generating common voltages to be applied to the plurality of common electrodes, including generating a first common voltage V0 and a second common voltage V4 above and under the central common voltage V2, respectively, which exceed the first and second segment voltages V1, V3, the step of generating common voltages including supplying a predetermined constant voltage to a dividing circuit, in which a first resistor and a second resistor are arranged in series, using the voltage output from the connection of one terminal of the first resistor and one terminal of the second resistor as the central common voltage V2, using the voltage output from the other terminal of the first resistor as the first segment voltage V1, and using the voltage output from the other terminal of the second resistor is used as the second segment voltage V3.

31. A method for driving a matrix type liquid crystal display in which a plurality of common electrodes and a plurality of segment electrodes are arranged in a way to cross each other through a liquid crystal, comprising the steps of:

generating segment voltages to be applied to the plurality of segment electrodes, including generating a first segment voltage V1 and a second segment voltage V3 above and under a central common voltage V2, respectively; and generating common voltages to be applied to the plurality of common electrodes, including generating a first common voltage V0 and a second common voltage V4 above and under the central common voltage V2, respectively, which exceed the first and second segment voltages V1, V3, the step of generating common voltages including supplying the central common voltage V2 and the second segment voltage V3 to a first differential amplifier having a gain exceeding 1, and inverting the second segment voltage V3 to generate the first common voltage V0, and supplying the central common voltage V2 and the first segment voltage V1 to a second differential amplifier having a gain exceeding 1, and inverting the first segment voltage V1 to generate the second common voltage V4.

32. A method for driving a matrix type liquid crystal display in which a plurality of common electrodes and a plurality of segment electrodes are arranged in a way to cross each other through a liquid crystal, the liquid crystal driving power source comprising:

generating a central common voltage V2 for the plurality of common electrodes;

supplying a predetermined constant current;

generating a first common voltage V0 from the central common voltage V2 and the predetermined constant current;

generating a first segment voltage V1 from the central common voltage V2 and the predetermined constant current;

generating a second common voltage V4 corresponding to the difference between the central common voltage V2 and the first common voltage V0;

generating a second segment voltage V3 corresponding to the difference between the central common voltage V2 and the first segment voltage V1; and shutting off the supplying step when displaying is not carried out.

* * * * *